US009504096B2

(12) United States Patent
Kakubari et al.

(10) Patent No.: US 9,504,096 B2
(45) Date of Patent: Nov. 22, 2016

(54) HEATER AND IMAGE HEATING APPARATUS INCLUDING THE SAME

(71) Applicant: CANON KABUSHIKI KAISHA, Tokyo (JP)

(72) Inventors: Koichi Kakubari, Toride (JP); Toshinori Nakayama, Kashiwa (JP); Shigeaki Takada, Abiko (JP); Masayuki Tamaki, Abiko (JP); Naoki Akiyama, Toride (JP); Akeshi Asaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/799,123

(22) Filed: Jul. 14, 2015

(65) Prior Publication Data

US 2016/0029435 A1 Jan. 28, 2016

(30) Foreign Application Priority Data

Jul. 24, 2014 (JP) ..... 2014-150778

(51) Int. Cl.
*G03G 15/20* (2006.01)
*H05B 1/02* (2006.01)
*H05B 3/22* (2006.01)

(52) U.S. Cl.
CPC ..... *H05B 1/0241* (2013.01); *G03G 15/2042* (2013.01); *G03G 15/2053* (2013.01); *H05B 3/22* (2013.01); *G03G 2215/2035* (2013.01)

(58) Field of Classification Search
CPC ..... G03G 15/80; G03G 15/2042; G03G 15/2053; H01C 17/06; H01C 17/28; H01C 17/283; H05B 1/0241; H05B 3/20; H05B 3/24
See application file for complete search history.

(56) References Cited

U.S. PATENT DOCUMENTS 7,200,354 B2 4/2007 Nakamoto et al.
7,260,351 B2 8/2007 Nakayama
(Continued)

FOREIGN PATENT DOCUMENTS

EP 2 711 778 A2 3/2014
JP 8-63020 A 3/1996
(Continued)

OTHER PUBLICATIONS

European Search Report mailed Dec. 17, 2015 in European Patent Application No. 15176237.4.
(Continued)

*Primary Examiner* — Erika J Villaluna
(74) *Attorney, Agent, or Firm* — Fitzpatrick, Cella, Harper & Scinto

(57) ABSTRACT

A heater includes: a substrate; a first electrical contact; second electrical contacts; first and second electrodes; heat generating portions; a first electroconductive line portion electrically connecting the first electrical contact and the first electrode portions; and a second electroconductive line portion electrically connecting one of the second electrical contacts and a part of the second electrode portions. A cross-sectional area of a portion, of the first electroconductive line portion, into which all of currents flowing through the first electrode portions merge when the currents flow from the first electrode portions toward the first electrical contact is larger than a cross-sectional area of a portion, of the second electroconductive line portion, into which all of currents flowing through the part of the second electrode portions merge when the currents flow from the part of the second electrode portions toward the one of second electrical contacts.

14 Claims, 17 Drawing Sheets

(56) References Cited

U.S. PATENT DOCUMENTS

| | | | |
|---|---|---|---|
| 7,263,303 | B2 | 8/2007 | Nakayama |
| 7,343,130 | B2 | 3/2008 | Nakayama |
| 7,430,392 | B2 | 9/2008 | Ito et al. |
| 7,457,576 | B2 | 11/2008 | Takada et al. |
| 7,460,821 | B2 | 12/2008 | Ai et al. |
| 7,466,950 | B2 | 12/2008 | Matsuura et al. |
| 7,590,366 | B2 | 9/2009 | Nakayama |
| 7,596,348 | B2 | 9/2009 | Nakamoto et al. |
| 7,729,628 | B2 | 6/2010 | Nakayama |
| 7,844,208 | B2 | 11/2010 | Hayashi et al. |
| 7,907,861 | B2 | 3/2011 | Nakayama |
| 8,145,086 | B2 | 3/2012 | Chiyoda et al. |
| 8,301,067 | B2 | 10/2012 | Takada |
| 8,306,446 | B2 | 11/2012 | Ito et al. |
| 8,559,837 | B2 | 10/2013 | Nakayama |
| 8,712,271 | B2 | 4/2014 | Nakayama et al. |
| 8,750,739 | B2 | 6/2014 | Tamaki et al. |
| 8,818,222 | B2 | 8/2014 | Tamaki |
| 8,867,941 | B2 | 10/2014 | Takada |
| 8,913,936 | B2 | 12/2014 | Takada et al. |
| 8,917,999 | B2 | 12/2014 | Takada et al. |
| 8,918,003 | B2 | 12/2014 | Kawai et al. |
| 8,929,762 | B2 | 1/2015 | Shinagawa et al. |
| 8,989,640 | B2 | 3/2015 | Kitagawa et al. |
| 2011/0082260 | A1 | 4/2011 | Omata et al. |
| 2012/0076521 | A1 | 3/2012 | Ishihara et al. |
| 2012/0224876 | A1 | 9/2012 | Nakayama et al. |
| 2013/0142532 | A1 | 6/2013 | Kitagawa et al. |
| 2013/0206745 | A1 | 8/2013 | Tanaka et al. |
| 2013/0299480 | A1 | 11/2013 | Kakubari et al. |
| 2013/0322897 | A1 | 12/2013 | Yago et al. |
| 2014/0076878 | A1* | 3/2014 | Shimura ..... G03G 15/2042 219/216 |
| 2014/0105658 | A1 | 4/2014 | Tamaki |
| 2014/0112692 | A1 | 4/2014 | Omata et al. |
| 2014/0353303 | A1 | 12/2014 | Fudo et al. |
| 2015/0212473 | A1 | 7/2015 | Kitagawa et al. |

FOREIGN PATENT DOCUMENTS

| | | | |
|---|---|---|---|
| JP | 3284580 | B2 | 5/2002 |
| JP | 2012-37613 | A | 2/2012 |
| JP | 2014-235315 | A | 12/2014 |
| WO | 2012 120867 | A1 | 9/2012 |

OTHER PUBLICATIONS

U.S. Appl. No. 14/718,672, filed May 21, 2015.
U.S. Appl. No. 14/719,497, filed May 22, 2015.
U.S. Appl. No. 14/719,474, filed May 22, 2015.
U.S. Appl. No. 14/844,249, filed Sep. 3, 2015.
U.S. Appl. No. 14/799,056, filed Jul. 14, 2015.
U.S. Appl. No. 14/857,086, filed Sep. 17, 2015.
U.S. Appl. No. 14/794,869, filed Jul. 9, 2015.
U.S. Appl. No. 14/718,557, filed May 21, 2015.

* cited by examiner

HEATER AND IMAGE HEATING APPARATUS INCLUDING THE SAME

FIELD OF THE INVENTION AND RELATED ART

The present invention relates to a heater for heating an image on a sheet and an image heating apparatus provided with the same. The image heating apparatus is usable with an image forming apparatus such as a copying machine, a printer, a facsimile machine, a multifunction machine having a plurality of functions thereof, or the like.

An image forming apparatus is known in which a toner image is formed on the sheet and is fixed on the sheet by heat and pressure in a fixing device (image heating apparatus). As for such a fixing device, a type of fixing device has been recently proposed (Japanese Laid-open Patent Application 2012-37613) in which a heat generating element (heater) is contacted to an inner surface of a thin flexible belt to apply heat to the belt. Such a fixing device is advantageous in that the structure has a low thermal capacity, and therefore, the temperature rise to a temperature required for the fixing operation is quick.

Japanese Laid-open Patent Application 2012-37613 discloses a fixing device in which a heat generating region width of the heat generating element (heater) is controlled in accordance with a width size of the sheet. The heater used in this fixing device is provided with a heat generating resistor layer on which a plurality of resistors are arranged in a longitudinal direction of a substrate, and each of the resistors is provided on the substrate with an electroconductive line layer including a plurality of electroconductive lines for supplying electric power (energy). This electroconductive line layer has a plurality of electroconductive line patterns different in the number of the resistors, and is constituted so as to be capable of selectively supplying the electric power to a specific resistor of the plurality of resistors. Further, this fixing device supplies the electric power to only a resistor, of the plurality of resistors, intended to be heated, so that a width size of a heat generating region of the heater is changed correspondingly to the plurality of resistors. The heater disclosed in Japanese Laid-Open Patent Application 2012-37613 is susceptible to further improvement with respect to the structure thereof. In the case where the electric power is supplied to such a heater, a part of the supplied electric power is consumed by the electrical resistance of the electroconductive line. More particularly, a larger amount of a current flows into the electroconductive line connected with a large number of a plurality of heat generation resistors layers, so that the amount of electric power consumption is larger. When the electric power is consumed by the electroconductive line, the heat generation efficiency at the heat generation resistor layer decreases, and therefore such a heater requires the electric power consumption to be suppressed.

SUMMARY OF THE INVENTION

Accordingly, it is an object of the present invention to provide a heater capable of suppressing electric power consumption.

It is another object of the present invention to provide an image heating apparatus capable of suppressing electric power consumption in the heater.

According to an aspect of the present invention, there is provided a heater usable with an image heating apparatus including an electric energy supplying portion provided with a first terminal and a second terminal, and an endless belt for heating an image on a sheet. The heater is contactable to the belt to heat the belt. The heater comprises: a substrate; a first electrical contact provided on the substrate and electrically connectable with the first terminal; a plurality of second electrical contacts provided on the substrate and electrically connectable with the second terminal; and a plurality of electrode portions including first electrode portions electrically connected with the first electrical contact and second electrode portions electrically connected with the second electrical contacts. The first electrode portions and the second electrode portions are arranged alternately with predetermined gaps in a longitudinal direction of the substrate. The apparatus also comprises a plurality of heat generating portions provided between adjacent ones of the electrode portions so as to electrically connect between adjacent electrode portions. The heat generating portions are capable of generating heat by electric power supply between adjacent electrode portions. The apparatus also comprises: a first electroconductive line portion configured to electrically connect the first electrical contact and the first electrode portions; and a second electroconductive line portion configured to electrically connect one of the plurality of second electrical contacts and a part of the second electrode portions. A cross-sectional area of a portion, of the first electroconductive line portion, into which all of currents flowing through the first electrode portions merge when the currents flow from the first electrode portions toward the first electrical contact is larger than a cross-sectional area of a portion, of the second electroconductive line portion, into which all of currents flowing through the part of the second electrode portions merge when the currents flow from the part of the second electrode portions toward the one of second electrical contacts.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer.

Embodiment 1

Image Forming Portion

Figure 1:
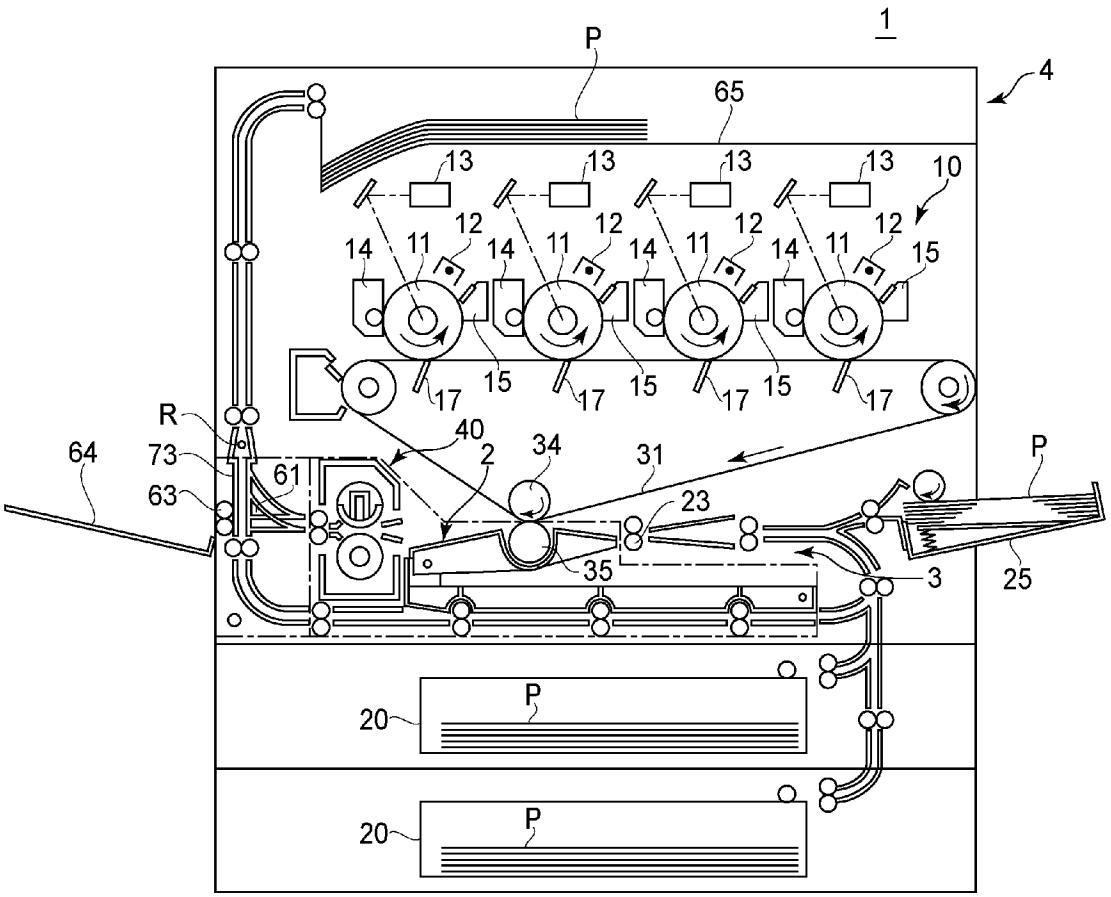
FIG. 1 is a sectional view of an image forming apparatus according to Embodiment 1.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and Bk (black). The image forming stations 10 includes respective photosensitive drums 11 corresponding to Y, M, C, Bk colors are arranged in the order named from the left side. Around each drum 11, similar elements are provided as follows: a charger 12; an exposure device 13; a developing device 14; a primary transfer blade 17; and a cleaner 15. The structure for the Bk toner image formation will be described as a representative, and the descriptions for the other colors are omitted for simplicity by assigning the like reference numerals. So, the elements will be simply called photosensitive drum 11, a charger 12, an exposure device 13, a developing device 14, a primary transfer blade 17 and a cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 or placed on a multi-feeding tray 25 is picked up by a feeding mechanism (unshown) and fed to a pair of registration rollers 23. The sheet P is a member on which the image is formed. Specific examples of the sheet P is plain paper, a thick sheet, a resin material sheet, an overhead projector film or the like. The pair of registration rollers 23 once stops the sheet P for correcting oblique feeding. The registration rollers 23 then feed the sheet P into the space between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
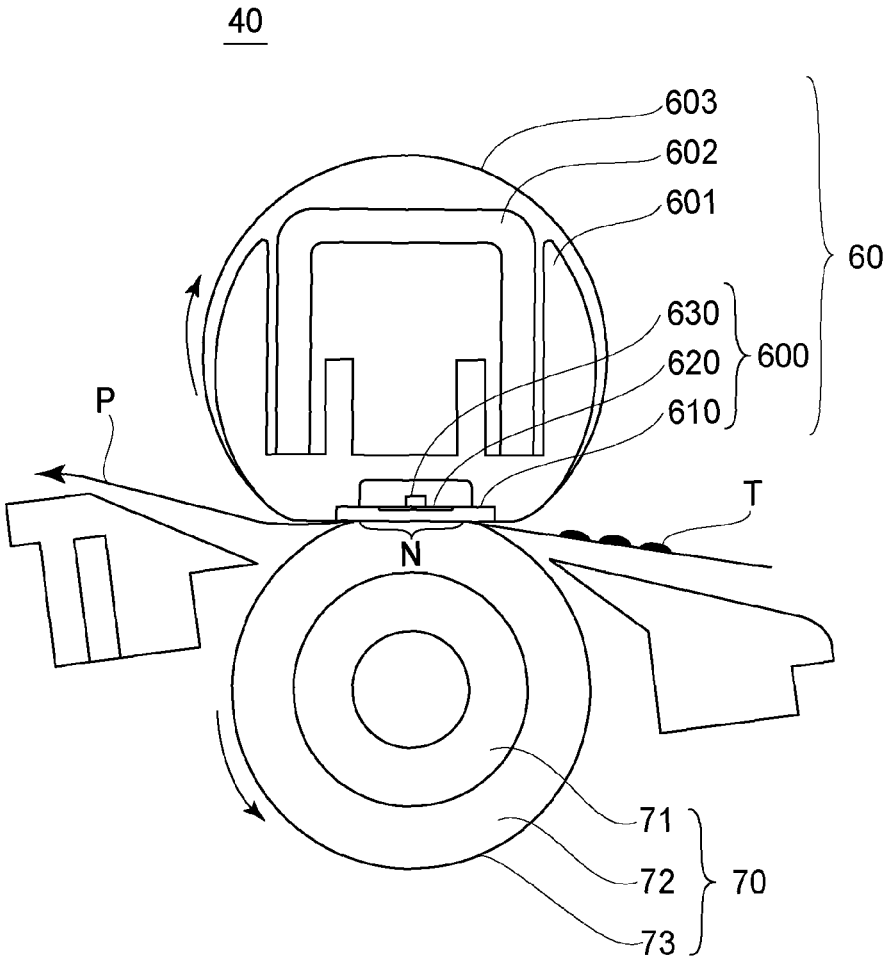
FIG. 2 is a sectional view of an image heating apparatus according to Embodiment 1.
Figure 3:
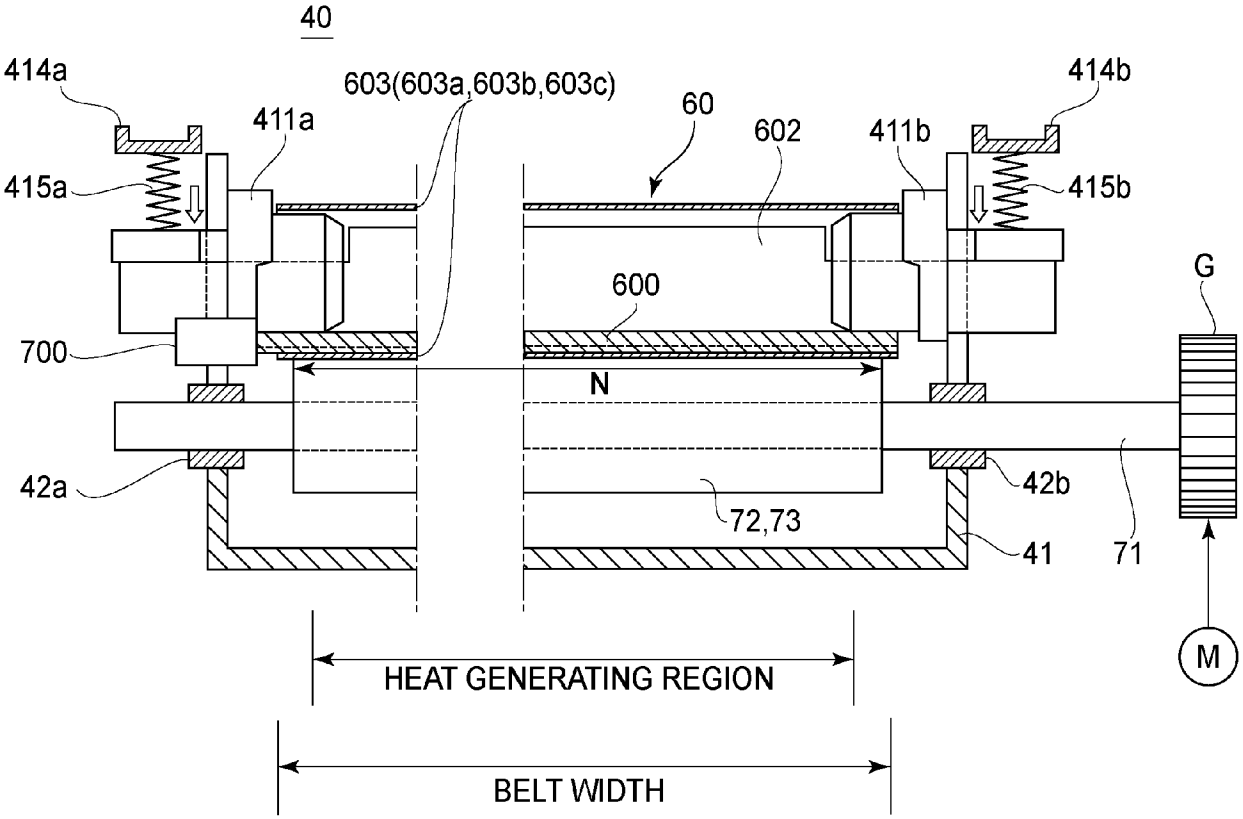
FIG. 3 is a front view of the image heating apparatus according to Embodiment 1.
Figure 4:
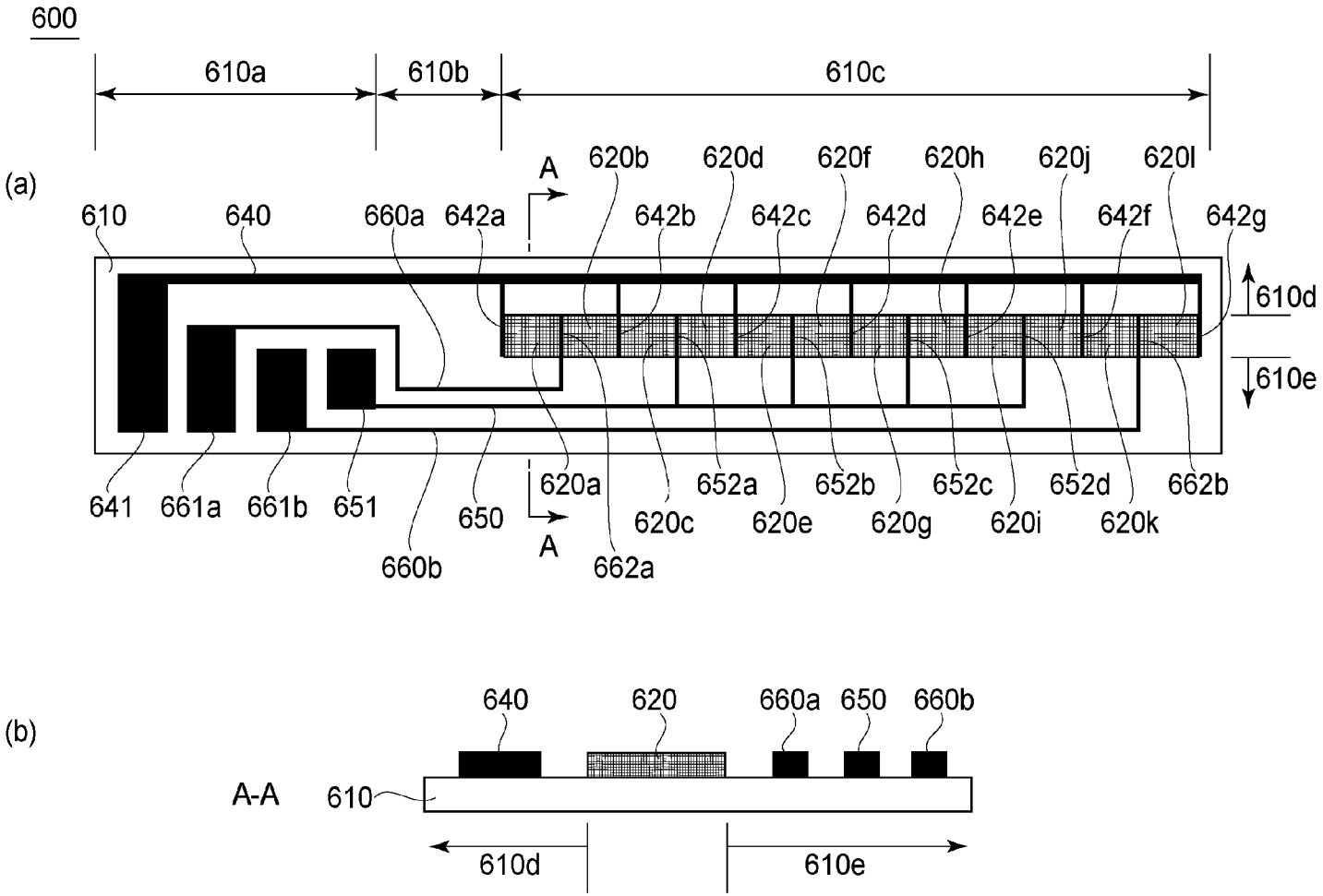
In FIG. 4, each of (a) and (b) illustrates a structure of a heater Embodiment 1.
Figure 5:
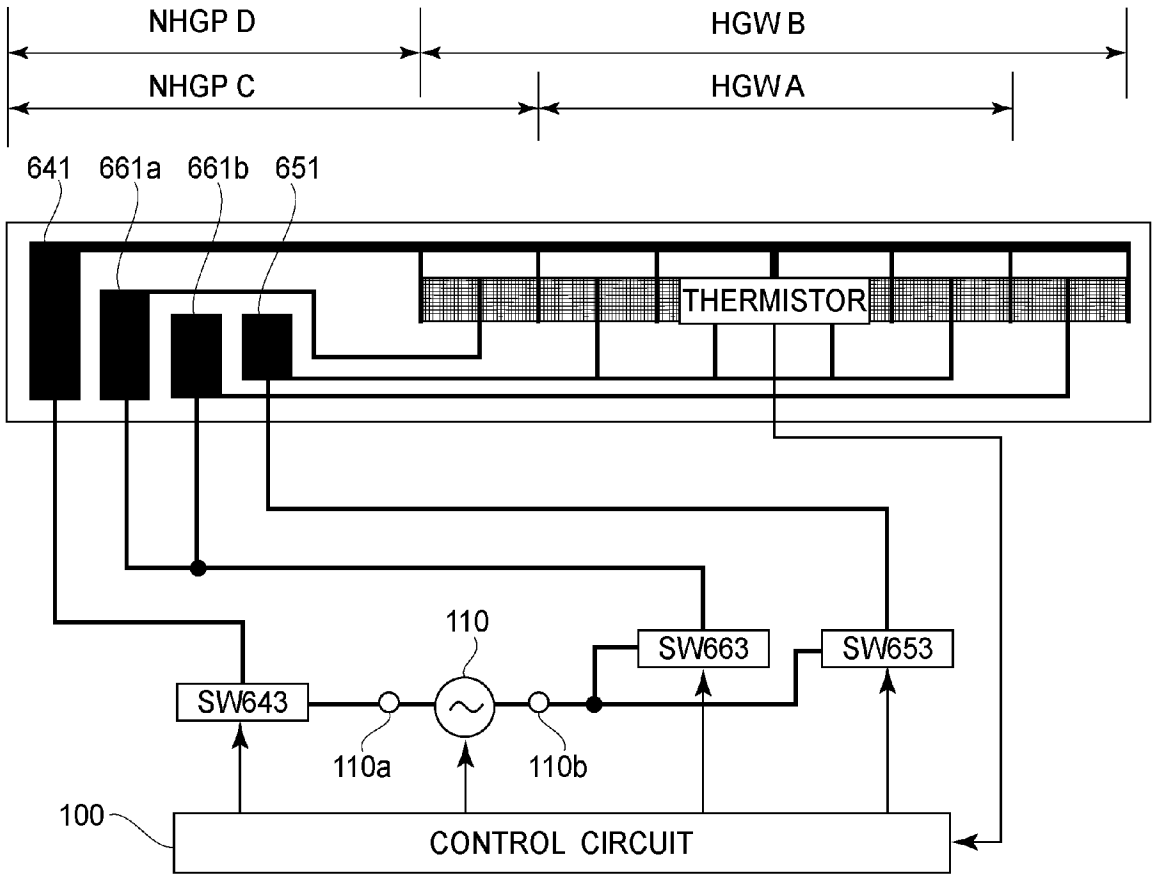
FIG. 5 illustrates the structural relationship of the image heating apparatus according to Embodiment 1.

The fixing device 40 which is the image heating apparatus used in the printer 1 will be described. FIG. 2 is a sectional view of the fixing device 40. FIG. 3 is a front view of the fixing device 40. FIG. 4 illustrates a structure of a heater 600. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and the heater 600 contacted to the inner surface of the belt 603 to heat the belt 603 (low thermal capacity structure). Therefore, the belt 603 can be efficiently heated, so that a quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a heating member for heating the belt 603, slidably contacting with the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the up-down direction in FIG. 4), 350-400 mm in the length (the dimension measured in the left-right direction in FIG. 4), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610*m* which is not in slidable contact with the belt 603, but the heat generating element 620 may be provided on the front surface of the substrate 610, which is in slidable contact with the belt 603. However, the heat generating element 620 of the heater 600 is preferably provided on the back side of the substrate 610, by which uniform heating effect to the substrate 610 is accomplished, from the standpoint of preventing the non-uniform heat application to the belt 603. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of 30 mm in the outer diameter, 330 mm in the length (the dimension measured in the front-rear direction in FIG. 2), 30 μm in the thickness, and the material of the base material 603*a* is nickel. The silicone rubber elastic layer 603*b* having a thickness of 400 μm is formed on the base material 603*a*, and a fluorine resin tube (parting layer 603*c*) having a thickness of 20 μm coats the elastic layer 603*b*.

The belt contacting surface of the substrate 610 may be provided with a polyimide layer having a thickness of 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface of FIG. 2) and functions to regulate a rotation orbit of the belt 603. The holder 601 may be made of heat resistive resin material or the like. In this embodiment, it is Zenite 7755 (trade name) available from Dupont. The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called the urging spring 415. With such a structure, an elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is 156.8 N (16 kgf) at one end portion side and 313.6 N (32 kgf) in total.

As shown in FIG. 3, a connector 700 is provided as an electric energy supply member electrically connected with the heater 600 to supply the electric power to the heater 600. The connector 700 is detachably provided at one longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing a good maintenance property. Details of the connector 700 will be described hereinafter.

A metal core is shown in FIG. 2, the roller 70 is a nip forming member which contacts an outer surface of the belt 603 to cooperate with the belt 603 to form the nip N. The roller 70 has a multi-layer structure on the metal core 71 of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core 71 of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are 25 mm in outer diameter, and 330 mm in length.

A thermistor 630 is a temperature sensor provided on a back side of the heater 600 (opposite side from the sliding surface side). The thermistor 630 is bonded to the heater 600 in the state that it is insulated from the heat generating element 620. The thermistor 630 has a function of detecting the a temperature of the heater 600. As shown in FIG. 5, the thermistor 630 is connected with a control circuit 100 through an A/D converter (unshown) and feeds an output corresponding to the detected temperature to the control circuit 100.

The control circuit 100 comprises a circuit including a CPU operating for various controls, and a non-volatile medium such as a ROM storing various programs. The programs are stored in the ROM, and the CPU reads and execute them to effect the various controls. The control circuit 100 may be an integrated circuit such as ASIC, if it is capable of performing the similar operation.

As shown in FIG. 5, the control circuit 100 is electrically connected with the voltage source 110 so as to control electric power supply from the voltage source 110. The control circuit 100 is electrically connected with the themistor 630 to receive the output of the themistor 630.

The control circuit 100 uses the temperature information acquired from the themistor 630 for the electric power supply control for the voltage source 110. More particularly, the control circuit 100 controls the electric power to the heater 600 through the voltage source 110 on the basis of the output of the themistor 630. In this embodiment, the control circuit 100 carries out a wave number control of the output of the voltage source 110 to adjust the amount of heat generation of the heater 600. By such a control, the heater 600 is maintained at a predetermined temperature (180 degree C., for example).

As shown in FIG. 3, the metal core 71 of the roller 70 is rotatably held by bearings 41*a* and 41*b* provided in a rear side and a front side of the side plate 41, respectively. One axial end of the metal core 71 is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving means for driving the roller 70 through the gear G. The control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (200 [mm/sec], for example).

[Heater]

Figure 11:
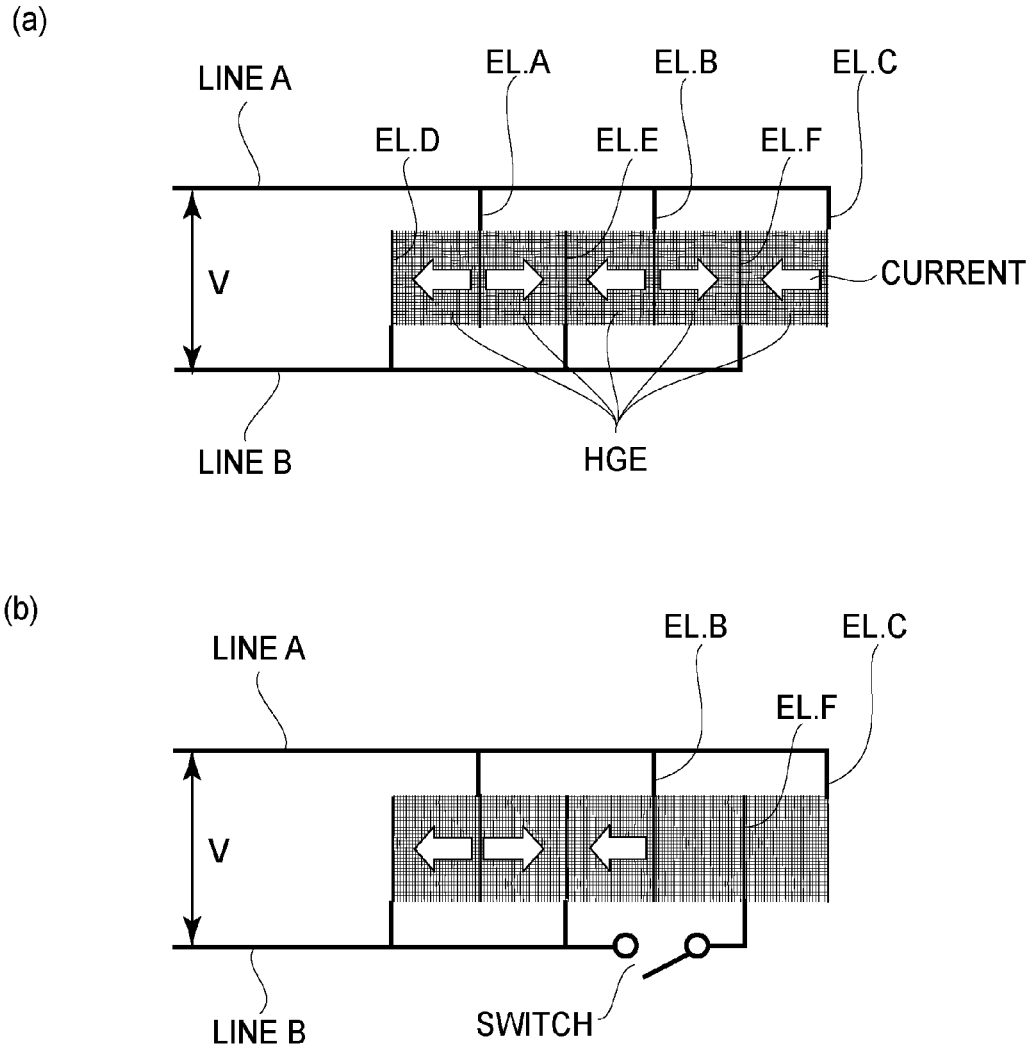
In FIG. 11, (a) illustrates a heat generating type for a heater, and (b) illustrates a switching system for a heat generating region of the heater.

The structure of the heater 600 used in the fixing device 40 will be described in detail. In FIG. 11, (a) illustrates a heat generating type used in the heater 600, and (b) illustrates a heat generating region switching type used with the heater 600.

The heater 600 of this embodiment is a heater using the heat generating type shown in (a) and (b) of FIG. 11. As shown in (a) of FIG. 11, electrodes A-C are electrically connected with A-electroconductive-line ("LINE A"), and electrodes D-F are electrically connected with B-electroconductive-line ("LINE B"). The electrodes connected with the A-electroconductive-lines and the electrodes connected with the B-electroconductive-lines are interlaced (alternately arranged) along the longitudinal direction (left-right direction in (a) of FIG. 11), and heat generating elements are electrically connected between the adjacent electrodes. The electrodes and the electroconductive lines are electroconductive patterns (lead wires) formed in a similar manner. In this embodiment, the lead wire contacted to and electrically connected with the heat generating element is referred to as the electrode, and the lead wire performing the function of connecting a portion, to which the voltage is applied, with the electrode is referred to as the electroconductive line (electric power supplying line). When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type heater, the heat is generated in the above-described the manner. As shown in (b) of FIG. 11, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing a switch or the like in the electroconductive line. In the heater 600, the heat generating region of the heat generating element 620 can be changed using the above-described system.

The heat generating element generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in (a) of FIG. 11) in the following way. When joule heat generation is effected by the electric energization of the heat generating element, the heat generating element generates heat correspondingly to the resistance (value) thereof, and therefore, the dimensions and the material of the heat generating element are selected in accordance with the direction of the electric current so that the resistance is at a desired level. The dimension of the substrate on which the heat generating element is provided is very short in the widthwise direction as compared with that in the longitudinal direction. Therefore, if the electric current flows in the widthwise direction, it is difficult to provide the heat generating element with a desired resistance, using a low resistance material. On the other hand, when the electric current flows in the longitudinal direction, it is relatively easy to provide the heat generating element with a desired resistance, using the low resistance material. In addition, when a high resistance material is used for the heat generating element, a temperature non-uniformity may result from non-uniformity in the thickness of the heat generating element when it is energized.

For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individually to the heat generating elements arranged in the longitudinal direction, it is preferable that the electrodes and the heat generating elements are disposed such that the directions of the electric current flow alternates between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of a short circuit. In addition, the number of required electrodes is large with the result of a large non-heat generating portion between the heat generating elements. Therefore, it is preferable to arrange the heat generating elements and the electrodes such that an electrode is made common between adjacent heat generating elements. With such an arrangement, the likelihood of a short circuit between the electrodes can be avoided, and the space between the electrodes can be eliminated.

In this embodiment, a common electroconductive line 640 shown in FIG. 4 corresponds to the A-electroconductive-line of (a) of FIG. 11, and opposite electroconductive lines 650, 660*a*, 660*b* correspond to B-electroconductive-line. In addition, common electrodes 642*a*-642*g* correspond to electrodes A-C of (a) of FIG. 11, and opposite electrodes 652*a*-652*d*, 662*a*, 662*b* correspond to electrodes D-F. Heat generating elements 620*a*-6201 correspond to the heat generating elements of (a) of FIG. 11. Hereinafter, the common electrodes 642*a*-642*g* are simply called a common electrode 642. The opposite electrodes 652*a*-652*d* are simply called an electrode 652. The opposite electrodes 662*a*, 662*b* are simply called an electrode 662. The opposite electroconductive lines 660*a*, 660*b* are simply called an electroconductive line 660. The heat generating elements 620*a*-6201 are simply called a heat generating element 620. The structure of the heater 600 will be described in detail referring to the accompanying drawings.

Figure 6:
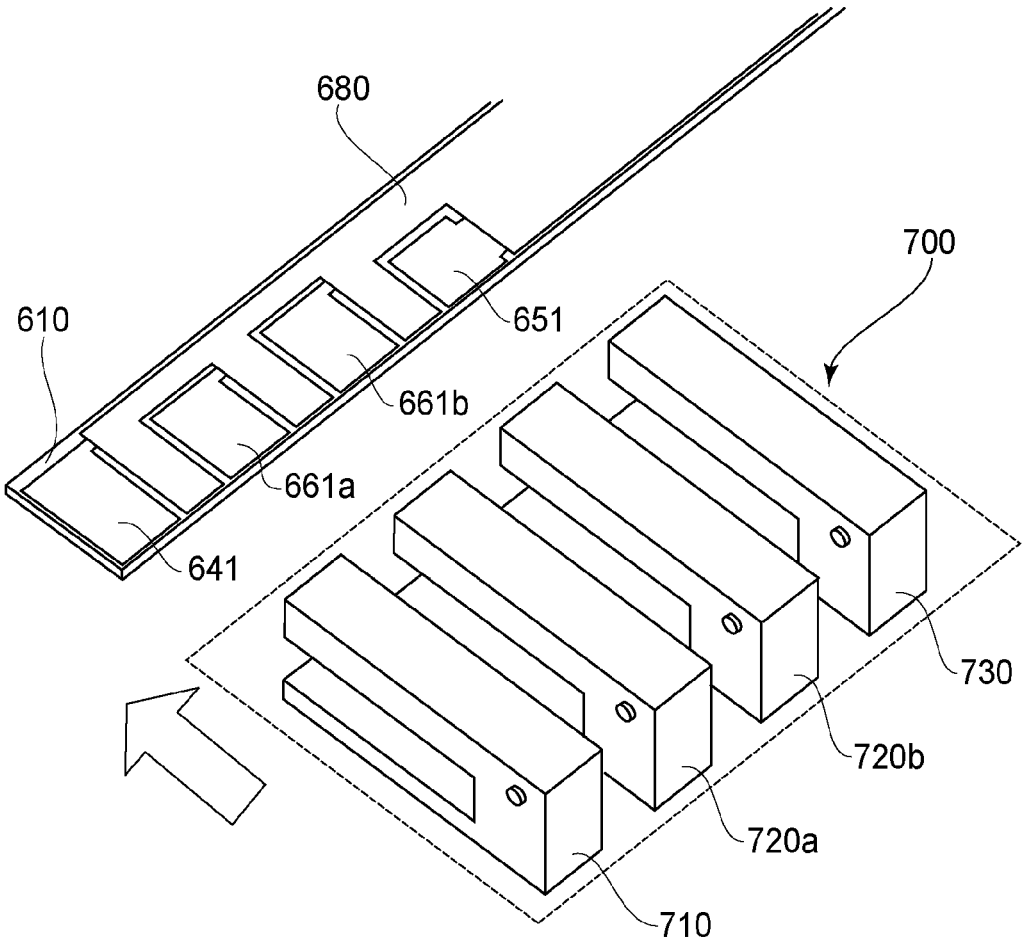
FIG. 6 illustrates a connector.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of 400 mm, a width (up-down direction in FIG. 4) of 10 mm and a thickness of 1 mm. The alumina plate member is 30 W/m·K in thermal conductivity.

On the back side of the substrate 610, the heat generating element 620 and the electroconductor pattern (electroconductive line) are provided through a thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As shown in FIG. 6, the heat generating element 620 and the electroconductor pattern are coated with the insulation coating layer 680 of heat resistive glass so that they are electrically protected from leakage and a short circuit. For that reason, in this embodiment, a gap between adjacent electroconductive lines can be provided narrowly. However, the heater 600 may also be not necessarily provided with the insulation coating layer 680. For example, by providing the adjacent electroconductive lines with a large gap, it is possible to prevent a short circuit between the adjacent electroconductive lines. However, it is desirable that a constitution in which the insulation coating layer 680 is provided from the viewpoint that the heater 600 can be downsized.

As shown in FIG. 4, there are provided electrical contacts 641, 651, 661*a*, 661*b* as a part of the electroconductor pattern in one end portion side of the substrate 610 with respect to the longitudinal direction. In addition, there are provided the heat generating element 620, the electrodes 642*a*-642*g* and the electrodes 652*a*-652*d*, 662*a*, 662*b* as a part of the electroconductor pattern in the other end portion side of the substrate 610 with respect to the longitudinal direction of the substrate 610. Between the one end portion side 610*a* of the substrate and the other end portion side 610*c*, there is a middle region 610*b*. In one end portion side 610*d* of substrate 610 beyond the heat generating element 620 with respect to the widthwise direction, the electroconductive line 640 as a part of the electroconductor pattern is provided. In the other end portion side 610*e* of the substrate 610 beyond the heat generating element 620 with respect to the widthwise direction, the electroconductive lines 650 and 660 are provided as a part of the electroconductor pattern.

The heat generating element 620 (620*a*-6201) is a resistor capable of generating joule heat by electric power supply (energization). The heat generating element 620 is one heat generating element member extending in the longitudinal direction on the substrate 610, and is disposed in the other end portion side 610*c* (FIG. 4) of the substrate 610. The heat generating element 620 has a desired resistance value, and has a width (measured in the widthwise direction of the substrate 610) of 1-4 mm, and a thickness of 5-20 μm. The heat generating element 620 in this embodiment has the width of 2 mm and the thickness of 10 μm. A total length of the heat generating element 620 in the longitudinal direction is 320 mm, which is enough to cover a width of the A4 size sheet P (297 mm in width).

On the heat generating element 620, seven electrodes 642*a*-642 which will be described hereinafter are laminated with intervals in the longitudinal direction. In other words, the heat generating element 620 is isolated into six sections by the electrodes 642*a*-642 *g* along the longitudinal direction. The lengths measured in the longitudinal direction of the substrate 610 of each section are 53.3 mm. On central portions of the respective sections of the heat generating element 620, one of the six electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements (plurality of heat generating portions, plurality of resistance elements) 620*a*-6201. In other words, the heat generating elements 620*a*-6201 electrically connect adjacent electrodes with each other. Lengths of the sub-section measured in the longitudinal direction of the substrate 610 are 26.7 mm. Resistance values of the sub-section of the heat generating element 620 with respect to the longitudinal direction are 120Ω. With such a structure, the heat generating element 620 is capable of generating heat in a partial area or areas with respect to the longitudinal direction.

The resistances of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent local temperature lowering at the longitudinal end portions of the heat generating element 620.

The electrodes 642 (642*a*-642*g*) are a part of the above-described electroconductor pattern. The electrode 642 extends in the widthwise direction of the substrate 610 perpendicular to the longitudinal direction of the heat generating element 620. In this embodiment, of the electroconductive pattern formed on the heater 600, only a region contacting the heat generating element 620 is called the electrode. In this embodiment, the electrode 642 is laminated on the heat generating element 620. The electrodes 642 are odd-numbered electrodes of the electrodes connected to the heat generating element 620, as counted from a one longitudinal end of the heat generating element 620. The electrode 642 is connected to one contact 110*a* of the voltage source 110 through the electroconductive line 640, which will be described hereinafter.

The electrodes 652, 662 are a part of the above-described electroconductor pattern. The electrodes 652, 662 extend in the widthwise direction of the substrate 610 perpendicular to the longitudinal direction of the heat generating element 620. The electrodes 652, 662 are the other electrodes of the electrodes connected with the heat generating element 620 other than the above-described electrode 642. That is, in this embodiment, they are even-numbered electrodes as counted from the one longitudinal end of the heat generating element 620.

That is, the electrode 642 and the electrodes 662, 652 are alternately arranged along the longitudinal direction of the heat generating element. The electrodes 652, 662 are connected to the other contact 110*b* of the voltage source 110 through the opposite electroconductive lines 650, 660, which will be described hereinafter.

The electrode 642 and the opposite electrode 652, 662 function as electrode portions for supplying the electric power to the heat generating element 620. In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four may be the opposite electrode 662.

The common electroconductive line 640 as a first feeder is a part of the above-described electroconductor pattern. The electroconductive line 640 extends along the longitudinal direction of the substrate 610 toward the one end portion side 610*a* of the substrate in the one end portion side 610*d* of the substrate. The electroconductive line 640 is connected with the electrodes 642 (642*a*-642*g*) which is in turn connected with the heat generating element 620 (620*a*-620*l*). In this embodiment, the electroconductive patterns connecting the electrodes with the electrical contacts are called the electroconductive lines. That is, also a region extending in the widthwise direction of the substrate 610 is a part of the electroconductive line. The electroconductive line 640 is connected to the electrical contact 641 which will be described hereinafter. In this embodiment, in order to assure the insulation of the insulation coating layer 680, a gap of 400 μm is provided between the electroconductive line 640 and each electrode.

The opposite electroconductive line 650 as a second feeder is a part of the above-described electroconductor pattern. The electroconductive line 650 extends along the longitudinal direction of substrate 610 toward the one end portion side 610*a* of the substrate in the other end portion side 610*e* of the substrate. The electroconductive line 650 is connected with the electrodes 652 (652*a*-652*d*) which are in turn connected with heat generating elements 620 (620*c*-620*j*). The opposite electroconductive line 650 is connected to the electrical contact 651 which will be described hereinafter.

The opposite electroconductive line 660 (660*a*, 660*b*) is a part of the above-described electroconductor pattern. The electroconductive line 660*a* as a third feeder (second feeder) extends along the longitudinal direction of substrate 610 toward the one end portion side 610*a* of the substrate in the other end portion side 610*e* of the substrate. The electroconductive line 660*a* is connected with the electrode 662*a* which is in turn connected with the heat generating element 620 (620*a*, 620*b*). The electroconductive line 660*a* is connected to the electrical contact 661*a* which will be described hereinafter. The electroconductive line 660*b* as a fourth feeder (third feeder) extends along the longitudinal direction of substrate 610 toward the one end portion side 610*a* of the substrate in the other end portion side 610*e* of the substrate. The electroconductive line 660*b* is connected with the opposite electrode 662*b* which is in turn connected with the heat generating element 620. The electroconductive line 660*b* is connected to the electrical contact 661*b* which will be described hereinafter. In this embodiment, in order to assure the insulation of the insulation coating layer 680, a gap of 400 μm is provided between the electroconductive line 660*a* and the common electrode 642. In addition, between the electroconductive lines 660*a* and 650 and between the electroconductive lines 660*b* and 650, gaps of 100 μm are provided.

The common electroconductive line 640 and the opposite electroconductive lines 650, 660 will be described hereinafter in detail.

The electrical contacts 641, 651, 661 (661*a*, 661*b*) as portions-to-be-energized are a part of the above-described electroconductor pattern. Each of the electrical contacts 641, 651, 661 preferably has an area of not less than 2.5 mm×2.5 mm in order to assure the reception of the electric power supply from the connector 700 as an energizing portion (electric power supplying portion) which will be described hereinafter. In this embodiment, the electrical contacts 641, 651, 661 has a length 3 mm measured in the longitudinal direction of the substrate 610 and a width of not less than 2.5 mm measured in the widthwise direction of the substrate 610. The electrical contacts 641, 651, 661*a*, 661*b* are disposed in the one end portion side 610*a* of the substrate beyond the heat generating element 620 with gaps of 4 mm in the longitudinal direction of the substrate 610. As shown in FIG. 6, no insulation coating layer 680 is provided at the positions of the electrical contacts 641, 651, 661*a*, 661*b* so that the electrical contacts are exposed. The electrical contacts 641, 651, 661*a*, 661*b* are exposed on a region 610*a* which is projected beyond an edge of the belt 603 with respect to the longitudinal direction of the substrate 610. Therefore, the electrical contacts 641, 651, 661*a*, 661*b* are contactable to the connector 700 to establish electrical connection therewith.

When voltage is applied between the electrical contact 641 and the electrical contact 651 via the electroconductive lines 640 and 650 through the connection between the heater 600 and the connector 700, a potential difference is produced between the electrode 642 (642*b*-642*f*) and the electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other.

When voltage is applied between the electrical contact 641 and the electrical contact 661*a* via the electroconductive lines 640 and 660*a* through the connection between the heater 600 and the connector 700, a potential difference is produced between the electrodes 642*a*, 642*b* and the electrode 662*a*. Therefore, through the heat generating elements 620*a*, 620*b*, the currents flow along the longitudinal direction of the substrate 610, the directions of the currents through the adjacent heat generating elements being opposite to each other.

When voltage is applied between the electrical contact 641 and the electrical contact 661*b* through the connection between the heater 600 and the connector 700, a potential difference is produced between the electrodes 642*f*, 642*g* and the electrode 662*b* through the electroconductive line 640 and the electroconductive line 660*b*. Therefore, through the heat generating elements 620*k*, 620*l*, the currents flow along the longitudinal direction of the substrate 610, the directions of the currents through the adjacent heat generating elements being opposite to each other.

In this manner, a part of the heat generating elements 620 can be selectively energized.

[Connector]

The connector 700 used with the fixing device 40 will be described in detail. The connector 700 of this embodiment is electrically connected with the heater 600 by mounting to the heater 600. The connector 700 comprises a contact terminal 710 electrically connectable with the electrical contact 641, and a contact terminal 730 electrically connectable with the electrical contact 651. The connector 700 also comprises a contact terminal 720*a* electrically connectable with the electrical contact 661*a*, and a contact terminal 720*b* electrically connectable with the electrical contact 661*b*. Further, the connector 700 comprises a housing 750 for integrally holding the contact terminals 710, 720*a*, 720*b*, 730. The contact terminal 710 is connected with a switch SW643 by a cable (unshown). The contact terminal 720*a* is connected with a switch SW663 by a cable (unshown). The contact terminal 720*b* is connected with the switch SW663 by a cable (unshown). The contact terminal 730 is connected with a switch SW653 by a cable (unshown). The connector 700 sandwiches a region of the heater 600 extending out of the belt 603 so as not to contact with the belt 603, by which the contact terminals an electrically connected with the electrical contacts, respectively. Further, as shown in FIG. 5, the electrical contact 641 is connected with SW643, the electrical contact 661*a* is connected with SW663, the electrical contact 661*b* is connected with SW663, and the electrical contact 651 is connected with SW653.

[Electric Energy Supply to Heater]

An electric energy supply method to the heater 600 will be described. The fixing device 40 of this embodiment is capable of changing a width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extend from the center portion. The electric energy supply to the heater 600 will be described in conjunction with the accompanying drawings.

The voltage source 110 is a circuit for supplying the electric power to the heater 600. In this embodiment, the commercial voltage source (AC voltage source) of 100V in effective value (single phase AC) is used. The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW653 connects or disconnects between the voltage source contact 110*b* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*b* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the voltage source 110, switch SW643, switch SW653, switch SW663 and the connector 700 functions as an electric power (energy) supplying means (electric power supplying portion) the electric power to the heater 600.

When the sheet P is a large size sheet (an introducible maximum width size), that is, when A3 size sheet is fed in the longitudinal direction or when the A4 size is fed in the landscape fashion, the width of the sheet P is 297 mm. Therefore, the control circuit 100 controls the electric power supply to provide the heat generation width B (FIG. 5) of the heat generating element 620. To effect this, the control circuit 100 renders ON all of the switch SW643, the switch SW653, and the switch SW663. As a result, the heater 600 is supplied with the electric power through the electrical contacts 641, 661*a*, 661*b*, 651, so that all of the 12 subsections of the heat generating element 620 generate heat. At this time, the heater 600 generates the heat uniformly over the 320 mm region to satisfy the heating requirements of the 297 mm sheet P.

When the size of the sheet P is a small size (narrower than the maximum width size by a predetermined width), that is, when an A4 size sheet is fed longitudinally, or when an A5 size sheet is fed in the landscape fashion, the width of the sheet P is 210 mm. Therefore, the control circuit 100 provides a heat generation width A (FIG. 5) of the heat generating element 620. Therefore, the control circuit 100 renders ON the switch SW643, the switch SW653 and renders OFF the switch SW663. As a result, the heater 600 is supplied with the electric power through the electrical contacts 641, 651, so that only 8 sub-sections of the 12 heat generating element 620 generate heat. At this time, the heater 600 generates the heat uniformly over the 213 mm region to satisfy the heating requirements of the 210 mm sheet P. When the heater 600 effects the heat generation of the heat generation width A, a non-heat-generating region of the heater 600 is called a non-heat-generating portion C. When the heater 600 effects the heat generation of the heat generation width B, a non-heat-generating region of the heater 600 is called a non-heat-generating portion D.

[Width of Common Electroconductive Line and Opposite Electroconductive Line]

Figure 7:
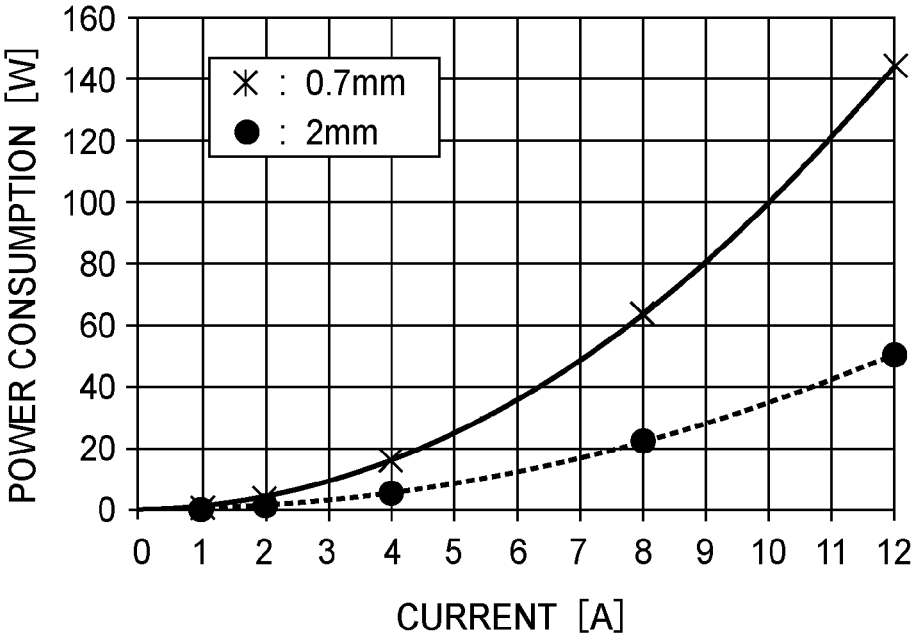
FIG. 7 is a graph showing a relationship between a current amount and electric power consumption with respect to different line widths of feeders.
Figure 8:
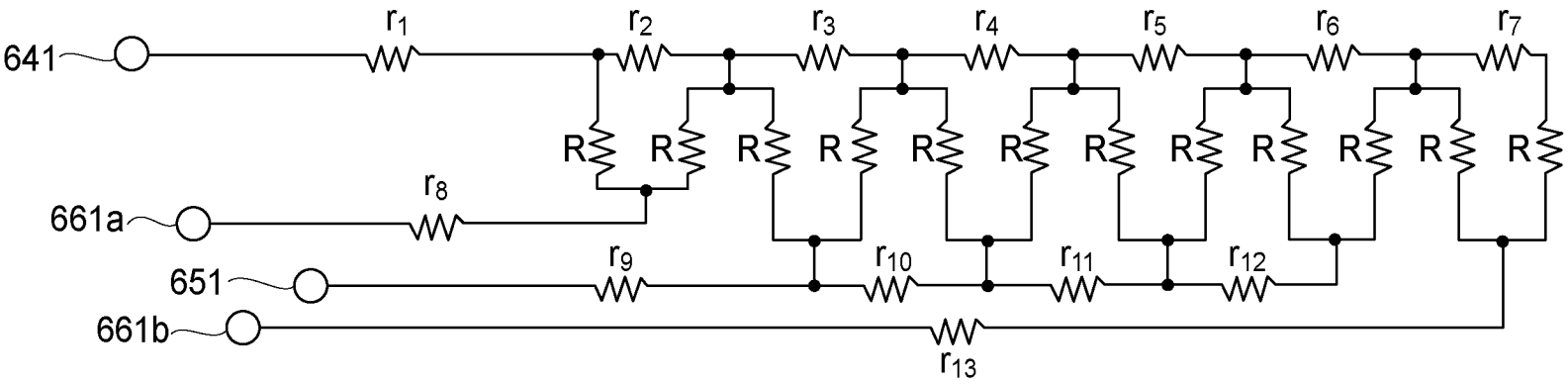
FIG. 8 illustrates an equivalent circuit of the heater.
Figure 9:
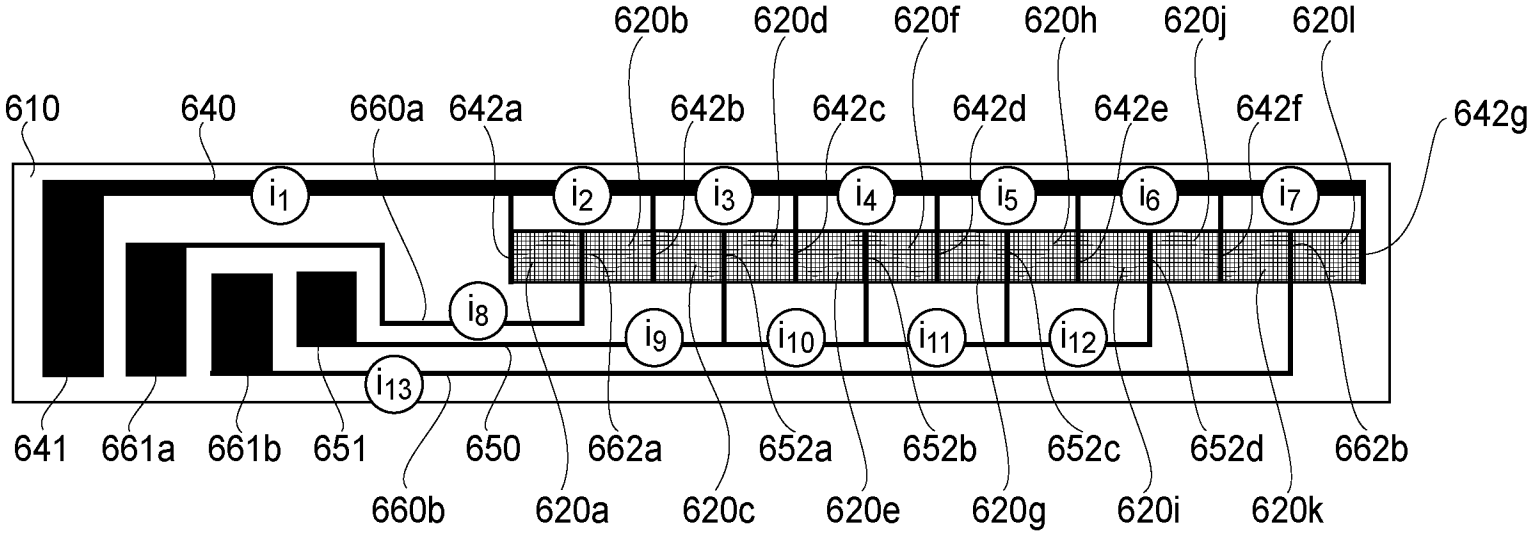
FIG. 9 illustrates a current flowing into the heater.
Figure 10:
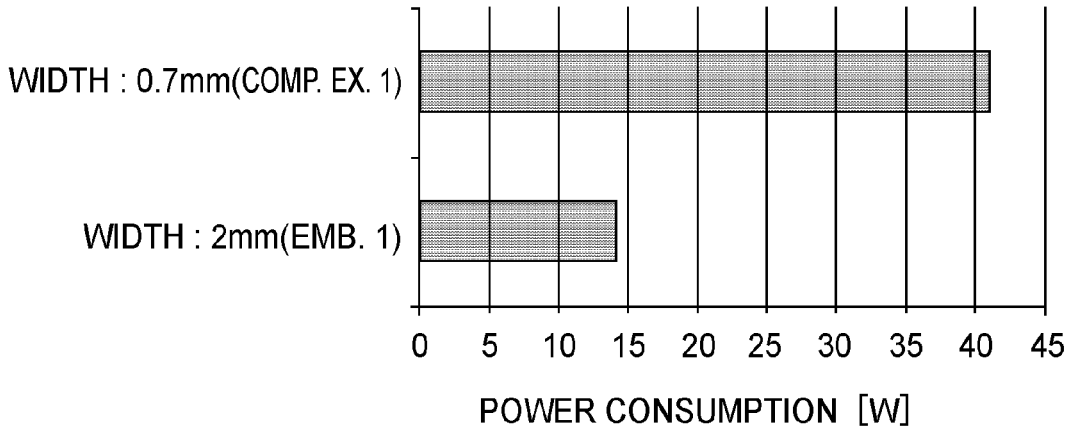
FIG. 10 illustrates an effect of Embodiment 1.

Widths of the common electroconductive line 640 and the opposite electroconductive lines 650, 660 (hereinafter, the common electroconductive line 640 and the opposite electroconductive lines 650, 660 are collectively referred to as a feeder (electric power feeder) in the case where these electroconductive lines are not required to be distinguished) will be described in detail. FIG. 7 illustrates a relationship among a line width, a current and electric power consumption of the feeder. FIG. 8 is a circuit diagram (equivalent circuit diagram for FIG. 4) of the heater 600. FIG. 9 is an illustration showing a current flowing through the heater 600. FIG. 10 illustrates an effect of this embodiment.

As in this embodiment, in the heater 600 changing the heat generating region depending on the width size of the sheet P, heat generation of the heater 600 in the region where the sheet P does not pass is suppressed. For that reason, the heater 600 has such a feature that an amount of heat generation unnecessary for the fixing process is small and thus the heater 600 is excellent in energy (electric power) efficiency. However, controllable heat generation in such a heater 600 is only heat generation of the heat generating element 620. For that reason, in the case where the heat generation is caused at a portion other than the heat generating element 620, there is a liability that the heat generation constitutes the heat generation unnecessary for the fixing process.

As the unnecessary heat generation, it is possible to cite heat generation caused at the feeder. The feeders such as the electroconductive line 640 and the electroconductive lines 650, 660 have a resistance to no small extent, and therefore when the current flows into the feeder, the feeder generates heat to no small extent. Further, in the case where the feeder generates heat, the heat generation thereof constitutes heat generation which does not readily contribute to the fixing, and therefore the electric power is uselessly consumed correspondingly. The heat generation which does not readily contribute to the fixing is, e.g., heat generation in a non-sheet P-passing region at longitudinal end portions of the heater 600 or heat generation in a region (region apart from the nip N) outside a region of 4 mm including the heat generating element 620 as a center with respect to the widthwise direction of the substrate 610. Accordingly, in order to efficiently use the electric power consumed by the heater 600 for the fixing process, it is desirable that the electric power consumption at the feeder is suppressed.

As a method of suppressing the electric power consumption of the feeder, it is possible to cite a reduction of the feeder resistance. A resistance r of the lead wire can be expressed by the following formula.

$$\text{Resistance } r=\rho\times L/(w\times t)$$

ρ: specific resistance, L: line length, w: line width, t: line thickness

Here, when the electric power is supplied to each of two lead wires different in line width w and prepared under the same condition except for the line width w, a relationship as shown in FIG. 7 is obtained. That is, as shown in FIG. 7, between the current and the electric power consumption, there is such a relationship that the electric power consumption increases with a larger current. Further, in the case where the same magnitude current is caused to flow, when the electric power consumption is compared between the lead wire of 2 mm in width and the lead wire of 0.7 mm in width, it is understood that the electric power consumption amount of the lead wire of 2 mm in width is smaller than that of the lead wire of 0.7 mm in width.

For that reason, it is desirable that the heater 600 is lowered in resistance by thickening the feeder width and thus the electric power consumption of the feeder is suppressed. However, when the width of all the feeders is simply thicken, a space for disposing the thick feeder is required on the substrate 610, and therefore there is a liability that the size of the substrate 610 is increased. Particularly, the influence of a change in width of the feeder on a widthwise size of the substrate 610 short in original dimension is conspicuous.

Accordingly, the feeder may desirably be provided in a proper thickness. For that reason, the feeder may desirably be different in thickness depending on a magnitude of a current flowing through the feeder. Specifically, with respect to the feeder, the lead wire through which a large current flows may desirably be provided in a large width, and the lead wire through which a small current flows may desirably be provided in a small width.

The feeder of the heater 600 is configured so that a total of currents flowing through the electroconductive lines 650, 660*a*, 660*b* concentratedly flows through a part of the lead wire for the electroconductive line 640. For that reason, the part of the lead wire for the electroconductive line 640 is liable to concentrate the electric power compared with another portion of the feeder. For that reason, the part of the lead wire through which the current concentratedly flows may desirably have a small electrical resistance. In this embodiment, the width of the part of the lead wire for the electroconductive line 640 is increased to lower the electroconductive line resistance, so that the electric power consumption at this portion is suppressed. On the other hand, with respect to the electroconductive lines 650, 660, even at the lead wire where the current most concentrates, the amount of the current is smaller than that of the current flowing through the part of the lead wire for the electroconductive line 640 described above. For that reason, in this embodiment, the width of the lead wire, extending along the longitudinal direction of the substrate, for the electroconductive lines 650, 660 is made smaller (thinner) than the width of the part of the lead wire for the electroconductive line 640. Accordingly, in this embodiment, the lead wire for the electroconductive lines 650, 660 arranged substantially in parallel can be disposed in a narrow space with respect to the widthwise direction of the substrate, so that an enlargement in size of the substrate 610 with respect to the widthwise direction can be suppressed. An adjusting method of the electroconductive line resistance is not limited thereto. For example, the line thickness of the electroconductive lines 640, 650, 660 may also be increased to about 20 μm-30 μm. Adjustment of the electroconductive line thickness can be realized performing repetitive coating in screen printing. However, from the viewpoint that the number of steps of the screen printing can be reduced, it is desirable that the constitution in this embodiment is employed. In the following description, a thick line width of the electroconductive line means that a cross-sectional area of the electroconductive line is large, and a narrow (thin) line width of the electrode means that a cross-sectional area of the electrode is small. A description will be provided in detail with reference to the drawings.

A structure of the feeder of the heart 600 in this embodiment will be described. In FIG. 8, resistances R show resistances of the heat generating elements 620*a*-620*l*. Further, in FIG. 8, resistances r1-r13 show resistances of the respective lead wires constituting the feeders. Specifically, the resistance of the lead wire extending from the electrical contact 641 to a point branching to the electrode 642*a* is r1.

The resistance of the lead wire extending from the point branching to the electrode 642*a* to a point branching to the electrode 642*b* is r2. That is, the resistance of the lead wire between the electrode 642*a* and the electrode 642*b* is r2. In the following, similarly, the respective lead wires will be described. The resistance of the lead wire between the electrode 642*b* and the electrode 642*c* is r3. The resistance of the lead wire between the electrode 642*c* and the electrode 642*d* is r4. The resistance of the lead wire between the electrode 642*d* and the electrode 642*e* is r5. The resistance of the lead wire between the electrode 642*e* and the electrode 642*f* is r6. The resistance of the lead wire between the electrode 642*f* and the electrode 642*g* is r7.

The resistance of the lead wire, for the electroconductive line 660*a*, extending from the electrical contact 661*a* to connect with the electrode 662*a* is r8. The resistance of the lead wire, for the electroconductive line 650, extending from the electrode 651 to a point branching to the electrode 652*a* is r9. Further, in the electroconductive line 650, the resistance of the lead wire between the electrode 652*a* and the electrode 652*b* is r10, the resistance of the lead wire between the electrode 652*b* and the electrode 652*c* is r11, and the resistance of the lead wire between the electrode 652*c* and the electrode 652*d* is r12.

The resistance of the lead wire, for the electroconductive line 660*b*, extending from the electrical contact 661*b* to connect with the electrode 662*b* is r13.

A relationship of currents flowing through the feeders will be described with reference to FIG. 9. In FIG. 9, the currents flowing through the electroconductive line 640 are represented by i1-i7, and the currents flowing through the electroconductive lines 650, 660 are represented by i8-i13. Specifically, in the electroconductive line 640, the current of the lead wire having the resistance r1 is i1, the current of the lead wire having the resistance r2 is i2, the current of the lead wire having the resistance r3 is i3, the current of the lead wire having the resistance r4 is i4, the current of the lead wire having the resistance r5 is i5, the current of the lead wire having the resistance r6 is i6, and the current of the lead wire having the resistance r7 is i7. Further, the current of the lead wire, for the electroconductive line 660*a*, having the resistance r8 is i8. Further, in the electroconductive line 650, the current of the lead wire having the resistance r9 is i9, the current of the lead wire having the resistance r10 is i10, the current of the lead wire having the resistance r11 is i11, and the current of the lead wire having the resistance r12 is i12. Further, the current of the lead wire, for the electroconductive line 660*b*, having the resistance r13 is i13.

In such a heater 600, in the case where the current flows from the heat generating element 620 toward the electrical contact 641, the current i1 into which the currents from the heat generating elements 620*a*-620*l* merge flows through the lead wire, for the electroconductive line 640, having the resistance r1. In this case, the magnitudes of the currents flowing through the respective lead wires for the electroconductive line 640 satisfy the relationship of: i1>i2>i3>i4>i5>i6>i7. The largest current flows through the lead wire having the resistance r1.

Further, in such a heater 600, in the case where the current flows from the heat generating element 620 toward the electrical contact 651, the current i9 into which the currents from the heat generating elements 620*c*-620*i* merge flows through the lead wire, for the electroconductive line 650, having the resistance r9. In this case, the magnitudes of the currents flowing through the respective lead wires for the electroconductive line 650 satisfy the relationship of: i9>i10>i11>i12.

Further, in such a heater 600, in the case where the current flows from the heat generating element 620 toward the electrical contact 661*a*, the current i8 into which the currents from the heat generating elements 620*a*, 620*b* merge flows through the lead wire, for the electroconductive line 660*a*, having the resistance r8.

Further, in such a heater 600, in the case where the current flows from the heat generating element 620 toward the electrical contact 661*b*, the current i13 into which the currents from the heat generating elements 620*k*, 620*l* merge flows through the lead wire, for the electroconductive line 660*b*, having the resistance r13.

Further, from a relationship of: i1=i8+i9+i13, the current i1 is larger than the currents i8, i9 and i13. For that reason, the lead wire having the resistance r1 may desirably be made thicker in width than the lead wire having the resistance r8, the lead wire having the resistance r9 and the lead wire having the resistance r13. In other words, the lead wire having the resistance r8, the lead wire having the resistance r9 and the lead wire having the resistance r13 may desirably be made thinner in width than the lead wire having the resistance r1. That is, when the current flowing from the heat generating elements 620 toward the electrical contact flows through the electroconductive line 650, the widthwise width of the lead wire, for the electroconductive line 650, through which the current, into which the currents from the heat generating elements 620*c*-620*j* merge, flows is as follows. That is, this width is narrower than the widthwise width of the lead wire, for the electroconductive line 640, through which the current, into which the currents from the heat generating elements 620 merge, flows when the current flowing from the heat generating elements 620 toward the electrical contact flow through the electroconductive line 640.

Therefore, in this embodiment, the width of the lead wire, for the electroconductive line 640, extending along the longitudinal direction of the substrate was set at 2.0 mm. The width of the lead wire extending from this lead wire and branching to the electrode 642 along the widthwise direction of the substrate was set at 0.4 mm. Further, in this embodiment, the width of the lead wire, for the electroconductive lines 650, 660, extending in the longitudinal direction of the substrate was set at 0.7 mm. The width of the lead wire extending from this lead wire and branching to the electrode 642 along the widthwise direction of the substrate was set at 0.4 mm. These lead wires may desirably have a uniform line width to the possible extent in the entire region in order to suppress a variation in resistance. However, these lead wires can locally cause an error of less than 0.1 m in line width depending on manufacturing accuracy. However, when the line widths in the entire region of the lead wires is averaged, the average approaches a desired line width. For that reason, the lead wires can obtain desired resistances. The feeders were 0.00002 Ω·mm in resistivity ρ and 10 μm in height h. When resistance values of the respective lead wires for the feeders are derived, the following result is obtained. That is, r1 is 0.47Ω, r2 to r7 are 0.53Ω, r8 is 0.173Ω, r9 is 0.227Ω, r10 to r12 are 0.153Ω, and r13 is 0.933Ω.

The resistance R of the respective heat generating elements 620 is 120Ω, and a combined resistance of the heat generating elements 520*a*-620*l* is 10Ω. Accordingly, in the case where a voltage of 100 V is applied to the heater 600, the electric power consumption of the heater 600 is ideally 100 W.

A result of the electric power supply of 100 V to the heater 600 including the feeders having the above-described constitutions so that the heat generating region is the heat generation width B is shown in Table 1. Table 1 shows the resistance, the current and the electric power consumption of each of the lead wires for the feeders. According to Table 1, the current i1 flowing through the lead wire having the resistance r1 is 9.67 A which is the largest value of values of the currents flowing through the feeders. However, the electroconductive line 640 in this embodiment is provided thickly so as to have the thick width of 2.0 mm, and therefore the resistance r1 is a low value of 0.047Ω. For that reason, the electric power consumption at the lead wire having the resistance r1 is suppressed to a low value of 4.39 W. This value of the electric power consumption is less than 1% (10 W) of 100 W which is the ideal electric power consumption of the heater 600, and therefore it can be said that the value is a sufficiently low value. In this embodiment, the width of each of the electroconductive lines 650, 660 is determined so that the electric power consumption of each of the lead wires for the electroconductive lines 650, 660 is less than 10 W similarly as in the case of the lead wire having the resistance r1. That is, the largest current of the respective lead wires for the electroconductive lines 650, 660 is i9 of 6.41 A, but the electric power consumption of the lead wire having the resistance r9 is 9.3 W which is less than 10 W.

TABLE 1

| Resistance (Ω) | | Current (A) | | Power (W) |
|---|---|---|---|---|
| r1 | 0.047 | i1 | 9.67 | 4.39 |
| r2 | 0.053 | i2 | 8.84 | 4.17 |
| r3 | 0.053 | i3 | 7.21 | 2.78 |
| r4 | 0.053 | i4 | 5.6 | 1.67 |
| r5 | 0.053 | i5 | 4 | 0.85 |
| r6 | 0.053 | i6 | 2.4 | 0.31 |
| r7 | 0.053 | i7 | 0.8 | 0.03 |
| r8 | 0.173 | i8 | 1.65 | 0.5 |
| r9 | 0.227 | i9 | 6.41 | 9.3 |
| r10 | 0.153 | i10 | 4.8 | 3.5 |
| r11 | 0.153 | i11 | 3.2 | 1.5 |
| r12 | 0.153 | i12 | 1.6 | 0.4 |
| r13 | 0.933 | i13 | 1.6 | 2.4 |

Therefore, in this embodiment, the width of the lead wire smaller in flowing current than the lead wire having the resistance r1 is made thinner than the width of the lead wire having the resistance r1. Specifically, the electroconductive line 650, the electroconductive line 660*a* and the electroconductive line 660*b* are made thinner (narrower) than the lead wire having the resistance r1. Here, description that the electroconductive line 650 is thinner than the lead wire having the resistance r1 is made above, but this means that the width (length with respect to the widthwise direction of the substrate) of the lead wire, for the electroconductive line 650, along the longitudinal direction of the substrate is uniformly thin compared with the width of the lead wire having the resistance r1. That is, the width of the lead wire, for the electroconductive line 650, along the longitudinal direction of the substrate is less than 2.0 mm. Accordingly, the width of the lead wire having the resistance r8 is less than 2.0 mm in the entire region with respect to the longitudinal direction of the lead wire having the resistance r8.

Further, a description that the electroconductive line 660*a* is thinner than the lead wire having the resistance r1 is provided above, but this means that the width (length with respect to the widthwise direction of the substrate) of the lead wire, for the electroconductive line 660*a*, extending along the longitudinal direction of the substrate is uniformly thin compared with the width of the lead wire having the resistance r1. That is, the width of the lead wire, for the electroconductive line 660*a*, along the longitudinal direction of the substrate is less than 2.0 mm. Accordingly, the width of the lead wire having the resistance r9 is less than 2.0 mm in the entire region with respect to the longitudinal direction of the lead wire having the resistance r9.

Further, a description that the electroconductive line 660*b* is thinner than the lead wire having the resistance r1 is provided above, but this means that the width (length with respect to the widthwise direction of the substrate) of the lead wire, for the electroconductive line 660*b*, extending along the longitudinal direction of the substrate is uniformly thin compared with the width of the lead wire having the resistance r1. That is, the width of the lead wire, for the electroconductive line 660*b*, along the longitudinal direction of the substrate is less than 2.0 mm. Accordingly, the width of the lead wire having the resistance r13 is less than 2.0 mm in the entire region with respect to the longitudinal direction of the lead wire having the resistance r13.

By such a constitution, in this embodiment, an arrangement space for the feeders arranged in the widthwise direction of the substrate 610 can be saved. For that reason, enlargement of the substrate 610 in the widthwise direction can be suppressed.

As described above, the heater 600 in this embodiment is 0.7 mm in width of the electroconductive lines 650,660 and 2.0 mm in width of the electroconductive line 640 with respect to the widthwise direction of the substrate. Accordingly, the sum of the line widths of the electroconductive line 640 and the electroconductive lines 650, 660*a*, 660*b* is 4.1 mm. In the case where the feeders are arranged in the widthwise direction of the substrate 610, in consideration of the width of the heat generating element 620 and the interval between the electroconductive lines, the widthwise length of the substrate 610 is 10 mm. Further, the sum of values of the electric power consumed by the heater 600 at the electroconductive line 640 is 14.2 W, and the sum of values of the electric power consumed by the heater 600 at the electroconductive lines 650, 660 is 17.6 W. That is, the electric power consumed by the heater 600 at the feeders is 31.8 W.

In order to verify an effect of this embodiment, a comparison with Comparison Examples is made. Comparison Example 1 is an example in the case where the width of the feeders in the heater 600 is uniformly 0.7 mm (the same width as that in this embodiment). Comparison Example 2 is an example in the case where the width of the feeders in the heater 600 is uniformly 2.0 mm (the same width as that in this embodiment). Comparison Example 3 is example in the case where the width of the feeders in the heater 600 is uniformly 1.025 mm (the sum of the respective line widths is 4.1 mm similarly as in this embodiment).

In the case where the voltage of 100 V is applied to the heater 600 in Comparison Example 1, the sum of the values of the electric power consumed by the electroconductive line 640 is 41 W, and the sum of the values of the electric power consumed by the electroconductive lines 650, 660 is 17.6 W. Accordingly, in this embodiment, as shown in FIG. 10, compared with Comparison Example 1, the electric power consumed at the electroconductive line 640 is reduced to about ⅓. Further, the sum of the values of the electric power consumed at the feeders is 58.6 W. That is, in this embodiment, compared with Comparison Example 1, the electric power consumed at the feeders is small.

Further, in the case where the voltage of 100 V is applied to the heater 600 in Comparison Example 2, the electric power consumption at the electroconductive line 640 can be reduced similarly as in Embodiment 1. However, the sum of the line widths of the electroconductive line 640 and the electroconductive lines 650, 660*a*, 660*b* in Comparison Example 2 is 8 mm. For that reason, in Comparison Example 2, the length of the substrate 610 with respect to the widthwise direction is 13.9 mm which is larger than 10 mm in Embodiment 1. That is, in this embodiment, compared with Comparison Example 2, the size of the substrate 610 with respect to the widthwise direction can be made small.

Further, in Comparison Example 3, the sum of the respective line widths of the feeders is 4.1 mm similarly as in Embodiment 1. Further, the widthwise length of the substrate 610 is 10 mm similarly as in Embodiment 1. However, between Comparison Example 3 and Embodiment 1, in the case where the voltage is applied to the heater 600, a difference in electric power consumed at the feeders generates. In the case where the voltage of 100 V is applied to the heater 600 in Comparison Example 3, the sum of the values of the electric power consumed by the heater 600 at the electroconductive line 640 is 27 W, and the sum of the values of the electric power consumed at the electroconductive lines 650, 660 is 12 W. That is, the electric power consumed by the heater 600 at the feeders in Comparison Example 3 is 39 W. Accordingly, in this embodiment, compared with Comparison Example 3, the electric power consumption at the electroconductive line can be reduced. That is, according to this embodiment, it is possible to suppress the electric power consumption at the feeders while suppressing enlargement in size of the substrate 610 with respect to the widthwise direction.

As described above, in this embodiment, in the heater 600, the width of the lead wire having the resistance r1 is made thicker than the widths of the lead wire having the resistance r8, the lead wire having the resistance r9 and the lead wire having the resistance r13. For that reason, it is possible to suppress the electric power consumption (heat generation) at the lead wire having the resistance r1. That is, in this embodiment, by preferentially lowering the resistance of the lead wire through which a large current flows, the electric power consumption at the feeders can be reduced.

The lead wire having the resistance r1 is positioned in the region, of the heater 600, where the sheet P does not pass. For that reason, the heat generated at the lead wire having the resistance r1 is liable to become heat unnecessary for the fixing process. That is, by suppressing the heat generation of the lead wire having the resistance r1, it is possible to reduce a degree of the heat generation unnecessary for the fixing process of the heater 600. Therefore, according to this embodiment, the heat generation of the heater 600 required for the fixing process can be made with high electric power efficiency.

Further, in this embodiment, the width of the electroconductive lines 650, 660 is made thinner than the width of the electroconductive line 640. For that reason, the electroconductive lines 650, 660 can be disposed in a narrow space of the substrate 610 with respect to the widthwise direction. For that reason, it is possible to suppress upsizing of the substrate 610 with respect to the widthwise direction. That is, according to this embodiment, by thinning the width of the lead wire through which a small current flows, it is possible to suppress the upsizing of the substrate 610 with respect to the widthwise direction. Further, an increase in cost of the heater 600 can be suppressed.

In the above description, the electroconductive line 640 of 2.0 mm in width of the lead wire along the longitudinal direction of the substrate is described as an example, but a shape of the electroconductive line 640 is not limited thereto. For example, as shown in (a) of FIG. 17, only the width of the lead wire portion, having the resistance r1, where the current concentrates may be set at 2.0 mm and the width of the lead wires having the resistances r2-r7 may be set at 0.7 mm. That is, at this time, a relationship of: (lead wire width with resistance r1)>(lead wire width with resistances r2-r7) is satisfied. In addition, the electroconductive line 640 may also be constituted so as to satisfy a relationship of: (lead wire width with resistance r1)>(lead wire width with resistance r2)>(lead wire width with resistance r3)>(lead wire width with resistance r4)>(lead wire width with resistance r5)>(lead wire width with resistance r6)>(lead wire width with resistance r7). That is, the electroconductive line 640 may also have the width narrowing with an increasing distance from the electrical contact 641. This is because there is a tendency that the value of the current flowing through the electroconductive line 640 is smaller at the position more distant from the electrical contact 641. Further, as shown in (b) of FIG. 17, the width of the electroconductive line 640 in the entire region may also be set at 2.0 mm. That is, the width of the lead wire portion, for the electroconductive line 640, branding toward the electrode and extending in the widthwise direction of the substrate may also be set at 2.0 mm. If the volume resistivity (specific resistance) values of the electroconductive line 640 and the electroconductive lines 650, 660 are substantially the same, even when different materials are used, the constitution in this embodiment is applicable.

Embodiment 2

Figure 12:
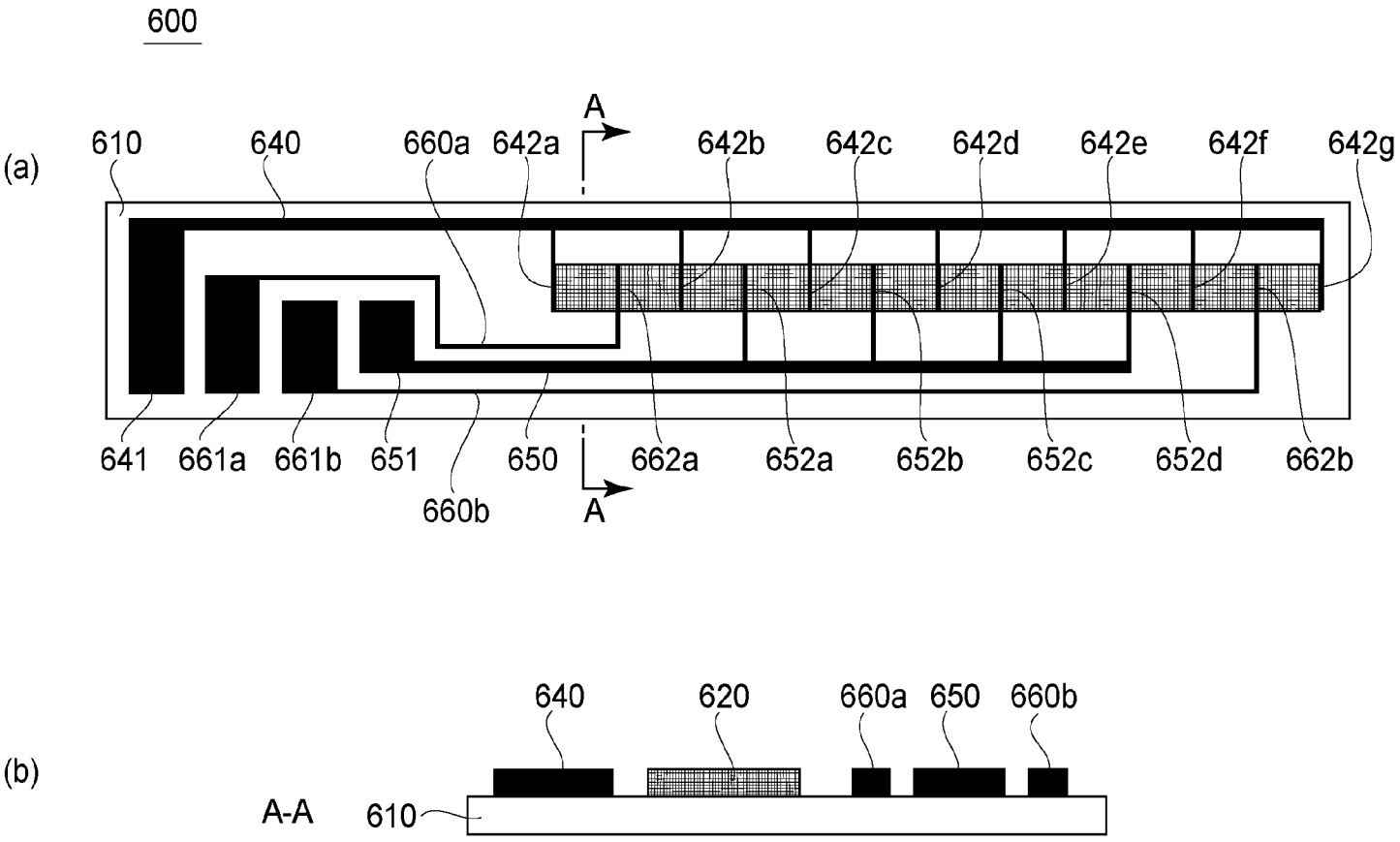
In FIG. 12, each of (a) and (b) illustrates a structure of a heater in Embodiment 2.
Figure 13:
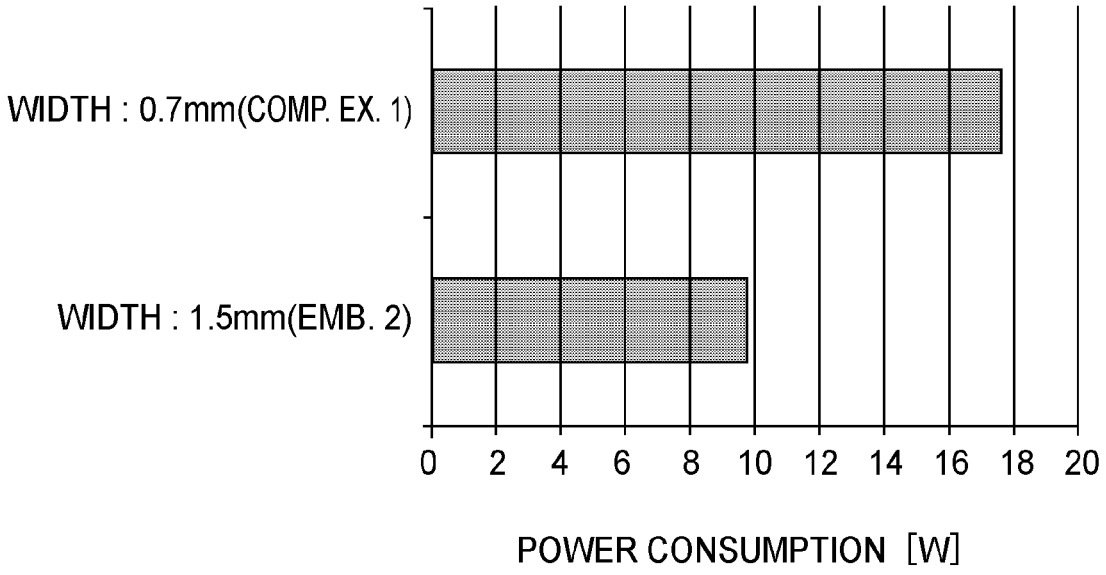
FIG. 13 illustrates an effect of Embodiment 2.

A heater according to Embodiment 2 of the present invention will be described. FIG. 12 illustrates a structure of a heater 600 in this embodiment. FIG. 13 illustrates an effect in this embodiment. In Embodiment 1, the line width of the electroconductive line 640 is made thick compared with the line width of the electroconductive lines 650, 660. On the other hand, in Embodiment 2, in addition to the constitution of Embodiment 1, the line width of the electroconductive line 650 is made thick compared with the line width of the electroconductive line 660. Specifically, this is because the number of the heat generating elements 620 connected with the electroconductive line 650 is larger than the number of the heat generating elements 620 connected with the electroconductive line 660 and an amount of the current flowing through the electroconductive line 650 is large compared with an amount of the current flowing through the electroconductive line 660. Further, the heater in this embodiment in which the electric power consumption at the electroconductive line 650 large in flowing current is suppressed is further excellent in energy (electric power) efficiency compared with the heater in Embodiment 1. In this way, by properly setting the thickness of the feeders depending on the magnitude (amount) of the flowing current, it is possible to suppress enlargement of the substrate 610 in the widthwise direction while suppressing the heat generation of the heater 600 at the feeders. Embodiment 2 is constituted similarly as in Embodiment 1 except for the constitution of the feeders. For that reason, the same reference numerals or symbols as in Embodiment 1 are assigned to the elements having the corresponding functions in this embodiment, and the detailed description thereof is omitted for simplicity.

In Embodiment 1, from a difference in magnitude between the current flowing through the electroconductive line 640 and the current flowing through the electroconductive lines 650, 660, the line width of the electroconductive lines 650, 660 was uniformly made thin compared with the line width of the electroconductive line 640. However, the magnitude of the flowing current is also different between the electroconductive lines 650 and 660. As shown in Table 1 in Embodiment 1, the largest current flowing through the electroconductive line 650 is 6.71 A. The current flowing through the electroconductive line 660*a* is 1.65 A. The current flowing through the electroconductive line 660*b* is 1.6 A. This difference in magnitude of the current is influenced by the number of the heat generating elements 620 with which the electroconductive lines 650, 660 are connected. The electroconductive line 650 is connected with 8 heat generating elements 620*c*-620*j* as shown in FIG. 12. For that reason, in the case where the current flows from the heat generating elements 620 toward the electrical contact 651, the current i9 into which the currents from the heat generating elements 620*c*-620*j* merge flows through the lead wire, for the electroconductive line 650, having the resistance r9. The heat generating elements 620*c*-620*j* are connected with the electroconductive line 650 in a parallel state, and therefore a combined resistance thereof is 15Ω.

Further, the electroconductive line 660*a* is connected with 2 heat generating elements 620*a*, 620*b*. For that reason, in the case where the current flows from the heat generating elements 620 toward the electrical contact 661*a*, the current i8 into which the currents from the heat generating elements 620*a*, 620*b* merge flows through the lead wire, for the electroconductive line 660*a*, having the resistance r8. The heat generating elements 620*a*, 620*b* are connected with the electroconductive line 660*a* in a parallel state, and therefore a combined resistance thereof is 60Ω.

Further, the electroconductive line 660*b* is connected with 2 heat generating elements 620*k*, 620*l*. For that reason, in the case where the current flows from the heat generating elements 620 toward the electrical contact 661*b*, the current i13 into which the currents from the heat generating elements 620*k*, 620*l* merge flows through the lead wire, for the electroconductive line 660*b*, having the resistance r13. The heat generating elements 620, 620*l* are connected with the electroconductive line 660*b* in a parallel state, and therefore a combined resistance thereof is 60Ω.

For that reason, at the electroconductive lines 650, 660*a*, 660*b* connected in parallel, the magnitude of the current flowing through the electroconductive line 650 is largest. That is, the electroconductive line 650 most readily generate heat. For that reason, in order to lower the resistance of the electroconductive line 650, it is desirable that the line width of the electroconductive line is made thick.

Therefore, in this embodiment, the width of the lead wire, for the electroconductive line 640, extending in the longitudinal direction of the substrate was set at 2.0 mm as shown in FIG. 13. The width of the lead wire extending from this lead wire and branching to the electrode 642 along the widthwise direction of the substrate was set at 0.4 mm. Further, in this embodiment, the width of the lead wire, for the electroconductive line 650 extending in the longitudinal direction of the substrate was set at 1.5 mm. The width of the lead wire extending from this lead wire and branching to the electrode 652 along the widthwise direction of the substrate was set at 0.4 mm. Further, the width of the lead wire extending in the longitudinal direction of the substrate was set at 0.7 mm. The width of the lead wire extending from this lead wire and branching to the electrode 662 along the widthwise direction of the substrate was set at 0.4 mm.

When resistance values of the respective sections for the feeders are derived, the following result is obtained. That is, r1 is 0.47Ω, r2 to r7 are 0.53Ω, r8 is 0.173Ω, r9 is 0.106Ω, r10 to r12 are 0.0712Ω, and r13 is 0.933Ω.

A result of the electric power supply of 100 V to the heater 600 including the feeders having the above-described constitutions so that the heat generating region is the heat generation width B is shown in Table 2. Table 2 shows the resistance, the current and the electric power consumption of each of the lead wires for the feeders. According to Table 2, the current i9 flowing through the lead wire having the resistance r9 is 6.41 A which is the largest value of values of the currents flowing through the electroconductive lines 650, 660. However, the electroconductive line 650 in this embodiment is provided thickly so as to have the thick width of 1.5 mm, and therefore the resistance r9 is a low value of 0.106Ω. For that reason, the electric power consumption at the lead wire having the resistance r9 is suppressed to a low value of 4.3 W. This value of the electric power consumption is less than 1% (10 W) of 100 W which is the ideal electric power consumption of the heater 600, and therefore it can be said that the value is a sufficiently low value. In this embodiment, the width of each of the electroconductive line 660 is determined so that the electric power consumption of each of the lead wires for the electroconductive lines 660*a*, 660*b* is less than 10 W similarly as in the case of the lead wire having the resistance r9. That is, the largest current of the respective lead wires for the electroconductive lines 650, 660 is i8 of 1.65 A, but the electric power consumption of the lead wire having the resistance r8 is 0.5 W which is less than 10 W.

TABLE 2

| Resistance (Ω) | | Current (A) | | Power (W) |
|---|---|---|---|---|
| r1 | 0.047 | i1 | 9.67 | 4.39 |
| r2 | 0.053 | i2 | 8.84 | 4.17 |
| r3 | 0.053 | i3 | 7.21 | 2.78 |
| r4 | 0.053 | i4 | 5.6 | 1.67 |
| r5 | 0.053 | i5 | 4 | 0.85 |
| r6 | 0.053 | i6 | 2.4 | 0.31 |
| r7 | 0.053 | i7 | 0.8 | 0.03 |
| r8 | 0.173 | i8 | 1.65 | 0.5 |
| r9 | 0.106 | i9 | 6.41 | 4.3 |
| r10 | 0.071 | i10 | 4.8 | 1.6 |
| r11 | 0.071 | i11 | 3.2 | 0.7 |
| r12 | 0.071 | i12 | 1.6 | 0.2 |
| r13 | 0.933 | i13 | 1.6 | 2.4 |

Therefore, in this embodiment, the width of the feeder smaller in flowing current than the lead wire having the resistance r9 is made thinner than the width of the lead wire having the resistance r9. Specifically, the electroconductive line 660*a* and the electroconductive line 660*b* are made thinner (narrower), in widthwise width of the substrate of the lead wire extending along the longitudinal direction of the substrate, than the lead wire having the resistance r1. Further, description that the electroconductive line 660*a* is thinner than the lead wire having the resistance r9 is made above, but this means that the width (length with respect to the widthwise direction of the substrate) of the lead wire, for the electroconductive line 660*a*, extending along the longitudinal direction of the substrate is uniformly thin compared with the width of the lead wire having the resistance r9. That is, the width of the lead wire, for the electroconductive line 660*a*, along the longitudinal direction of the substrate is less than 1.5 mm. Accordingly, also the width of the lead wire having the resistance r9 is less than 1.5 mm in the entire region with respect to the longitudinal direction of the lead wire having the resistance r9.

Further, description that the electroconductive line 660*b* is thinner than the lead wire having the resistance r9 is made above, but this means that the width (length with respect to the widthwise direction of the substrate) of the lead wire, for the electroconductive line 660*b*, extending along the longitudinal direction of the substrate is uniformly thin compared with the width of the lead wire having the resistance r9. That is, the width of the lead wire, for the electroconductive line 660*b*, along the longitudinal direction of the substrate is less than 1.5 mm. Accordingly, also the width of the lead wire having the resistance r13 is less than 1.5 mm in the entire region with respect to the longitudinal direction of the lead wire having the resistance r13.

By such a constitution, in this embodiment, a space in which the feeders are arranged in parallel in the widthwise direction of the substrate 610 can be saved. For that reason, enlargement in size of the substrate 610 in the widthwise direction can be suppressed.

As described above, the heater 600 in this embodiment is 1.5 mm in width of the electroconductive line 650, 0.7 mm in width of the electroconductive line 660 and 2.0 mm in width of the electroconductive line 640. For that reason, the sum of the line widths with respect to the widthwise direction of the substrate is 4.9 mm. In the case where the feeders are arranged in the widthwise direction of the substrate 610, in consideration of the width of the heat generating element 620 and the interval between the electroconductive lines, the widthwise length of the substrate 610 is 10.8 mm. Further, the sum of values of the electric power consumed by the heater 600 at the electroconductive line 640 is 14.1 W, and the sum of values of the electric power consumed by the heater 600 at the electroconductive lines 650, 660 is 7.1 W. That is, the electric power consumed by the heater 600 at the feeders is 21.2 W.

In order to verify an effect of this embodiment, a comparison with Comparison Examples is made. Comparison Example 4 is an example in the case where the width of the feeders in the heater 600 is uniformly 1.225 mm (the sum of the respective line widths is 4.9 mm similarly as in this embodiment).

In Comparison Example 4, the sum of the respective line widths of the feeders is 4.9 mm similarly as in Embodiment 2. Further, the widthwise length of the substrate 610 is 10.8 mm similarly as in Embodiment 2. However, between Comparison Example 4 and Embodiment 2, in the case where the voltage is applied to the heater 600, a difference in electric power consumed at the feeders generates. In the case where the voltage of 100 V is applied to the heater 600 in Comparison Example 4, the sum of the values of the electric power consumed by the heater 600 at the electroconductive line 640 is 27 W, and the sum of the values of the electric power consumed at the electroconductive lines 650, 660 is 12 W. That is, the electric power consumed by the heater 600 at the feeders in Comparison Example 4 is 39 W. Accordingly, in this embodiment, compared with Comparison Example 4, the electric power consumption at the electroconductive line can be reduced. That is, according to this embodiment, it is possible to suppress the electric power consumption at the feeders while suppressing enlargement in size of the substrate 610 with respect to the widthwise direction.

Further, in Embodiment 2, similarly as in Embodiment 1, the electric power consumption of the heater 600 is smaller than that in Comparison Example 2 and the widthwise length of the substrate is shorter than that in Comparison Example 1. Incidentally, the electric power consumed at the electroconductive lines 650, 660 in Embodiment 2 is sufficiently smaller than that in Comparison Example 1. As shown in FIG. 13, the electric power consumed by the heater 600 at the electroconductive lines 650, 660 in Embodiment 2 is about ½ of the electric power consumed by the heater at the electroconductive lines 650, 660 in Comparison Example 1.

As described above, in this embodiment, in the heater 600, the width of the lead wire having the resistance r1 is made thicker than the widths of the lead wire having the resistance r8, the lead wire having the resistance r9 and the lead wire having the resistance r13. For that reason, it is possible to suppress the electric power consumption (heat generation) at the lead wire having the resistance r1. That is, in this embodiment, by preferentially lowering the resistance of the lead wire through which a large current flows, the electric power consumption at the feeders can be reduced.

The lead wire having the resistance r1 is positioned in the region, of the heater 600, where the sheet P does not pass. For that reason, the heat generated at the lead wire having the resistance r1 is liable to become heat unnecessary for the fixing process. That is, by suppressing the heat generation of the lead wire having the resistance r1, it is possible to reduce a degree of the heat generation unnecessary for the fixing process of the heater 600. Therefore, according to this embodiment, the heat generation required for the fixing process can be made with high electric power efficiency.

Further, in this embodiment, the width of the electroconductive lines 650, 660 is made thinner than the width of the electroconductive line 640. For that reason, the electroconductive lines 650, 660 can be disposed in a narrow space of the substrate 610 with respect to the widthwise direction. Further, in this embodiment, the width of the electroconductive line 660 is made thinner than the width of the electroconductive line 650. For that reason, the electroconductive line 660 can be disposed in a narrow space of the substrate 610 with respect to the widthwise direction. For that reason, it is possible to suppress upsizing of the substrate 610 with respect to the widthwise direction. That is, according to this embodiment, by thinning the width of the lead wire through which a small current flows, it is possible to suppress the upsizing of the substrate 610 with respect to the widthwise direction. Further, an increase in cost of the heater 600 can be suppressed.

In the above description, the electroconductive line 650 of 1.5 mm in width of the lead wire along the longitudinal direction of the substrate is described as an example, but a shape of the electroconductive line 650 is not limited thereto. For example, only the width of the lead wire portion, having the resistance r9, where the current concentrates may be set at 1.5 mm and the width of the lead wires having the resistances r10-r12 may be set at 0.7 mm. That is, at this time, a relationship of: (lead wire width with resistance r9)>(lead wire width with resistances r10-r12) is satisfied. In addition, the electroconductive line 650 may also be constituted so as to satisfy a relationship of: (lead wire width with resistance r9)>(lead wire width with resistance r10)>(lead wire width with resistance r11)>(lead wire width with resistance r12). That is, the electroconductive line 650 may also have the width narrowing with an increasing distance from the electrical contact 651. This is because there is a tendency that the value of the current flowing through the electroconductive line 650 is smaller at the position more distant from the electrical contact 651. Further, the width of the electroconductive line 650 in the entire region may also be set at 1.5 mm. That is, the width of the lead wire portion, for the electroconductive line 650, branding toward the electrode and extending in the widthwise direction of the substrate may also be set at 1.5 mm. Even such a constitution is applicable to this embodiment.

Embodiment 3

Figure 16:
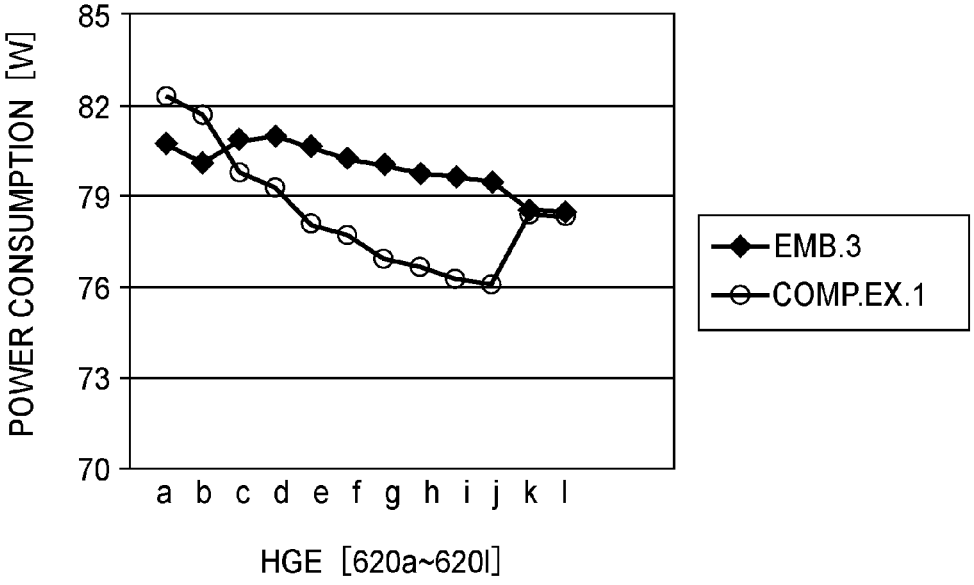
FIG. 16 is a graph for illustrating the effect of Embodiment 3.
Figure 17:
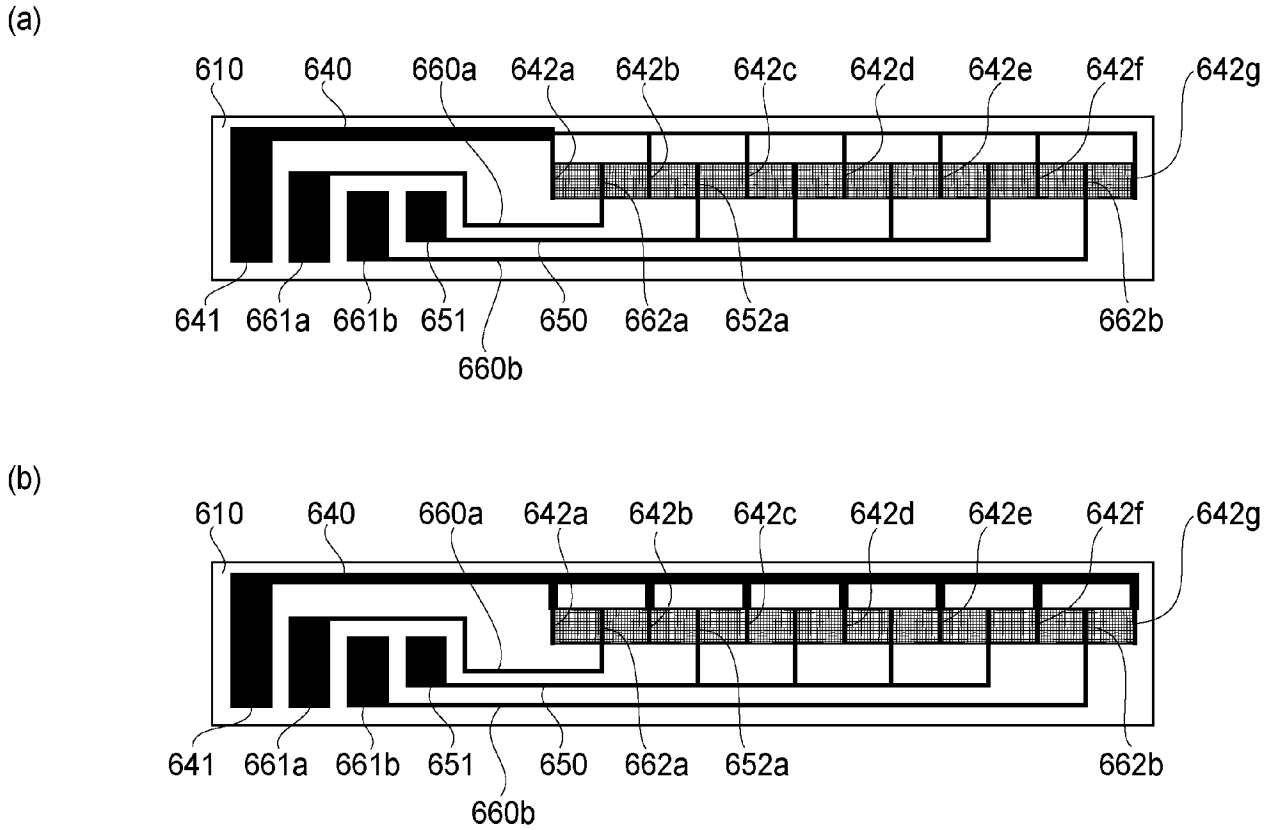
In FIG. 17, (a) illustrates a structure of a first modified example, and (b) illustrates a structure of a second modified example in Embodiment 1.

A heater according to Embodiment 3 of the present invention will be described. FIG. 12 illustrates a structure of a heater 600 in this embodiment. FIG. 13 is an illustrates an effect in this embodiment. FIG. 16 illustrates a state of a temperature distribution of the heater 600 in each of Embodiment 3 and Comparison Example 1. In FIG. 17, (a) illustrates a constitution of a first modified embodiment, and (b) illustrates a constitution of a second modified embodiment.

In Embodiment 1, the line width of the electroconductive line 640 is made thick compared with the line width of the electroconductive lines 650, 660. In Embodiment 3, in addition to the constitution of Embodiment 2, the line width of the electroconductive line 660*b* is made thick compared with the line width of the electroconductive line 660*a*.

Specifically, a length of a path of the electroconductive line 660*b* connecting the electrical contact 661*b* and the heat generating elements 620*k*, 620*l* is longer than a length of a path of electroconductive line 660*a* connecting the electrical contact 661*a* and the heat generating elements 620*a*, 620*b*. For that reason, the line width of the electroconductive line 660*b* is made thick compared with the line width of the electroconductive line 660*a*. For that reason, the fixing device 40 in this embodiment has the constitution further excellent in energy (electric power) efficiency compared with Embodiment 2.

Further, in this embodiment, the line widths of the respective electroconductive lines are adjusted so that the resistances of the electroconductive lines 650, 660*a*, 660*b* are the same. For that reason, the value of the electric power consumed between the associated electrical contact and the associated electrode are close to each other, so that it is possible to supply substantially the same electric power to each of the heat generating elements. Accordingly, the heater 600 can generate heat uniformly with respect to the longitudinal direction. That is, it is possible to suppress the heat generation non-uniformity of the heater 600 due to voltage drop by the electroconductive lines. Embodiment 3 is constituted similarly as in Embodiment 2 except for the above-described differences. For that reason, the same reference numerals or symbols as in Embodiment 2 are assigned to the elements having the corresponding functions in this embodiment, and the detailed description thereof is omitted for simplicity.

In Embodiment 2, from a difference in magnitude between the currents flowing through the feeders, the line width of the electroconductive lines 660*a*, 660*b* was made thin compared with the line width of the electroconductive line 650. Further, the amounts of the currents flowing through the electroconductive line 660*a* and the electroconductive line 660*b* are substantially the same, and therefore the electroconductive lines 660*a*-660*b* are made the same in width. However, values of the electric power consumed by the electroconductive lines 660*a*, 660*b* are different from each other. According to Table 2, the electric power consumption of the electroconductive line 660*a* is 0.5 W, whereas the electric power consumption of the electroconductive line 660*b* is 2.4 W. This difference in electric power consumption results from the difference in path length between the electroconductive line 660*a* and the electroconductive line 660*b*. That is the electroconductive line 660*b* is larger in path length than the electroconductive line 660*a*, and therefore the resistance becomes large. For that reason, the line width of the electroconductive line 660*b* may desirably be thicker than the line width of the electroconductive line 660*a*. In other words, the line width of the electroconductive line 660*a* may desirably be thinner than the line width of the electroconductive line 660*b*. The resistance r can be represented by the following formula.

$$\text{Resistance } r=\rho\times L/(w\times t)$$

ρ: specific resistance, L: line width, w: line width, t: line thickness

Figure 14:
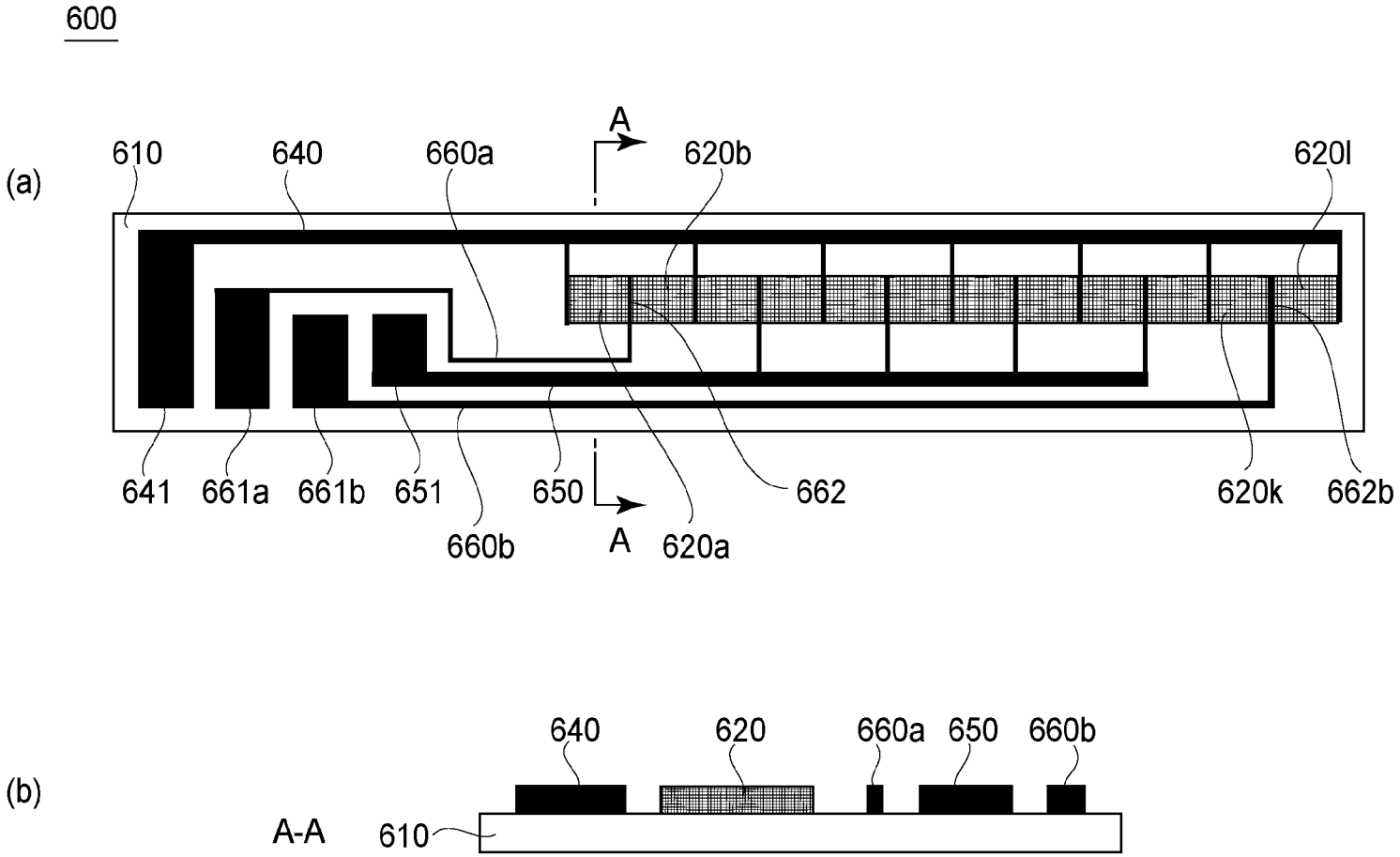
In FIG. 14, each of (a) and (b) illustrates a structure of a heater in Embodiment 3.

In this embodiment, as shown in FIG. 14, the width of the lead wire, for the feeder, extending along the longitudinal direction of the feeder was set at 2.6 mm for the electroconductive line 640, 2.5 mm for the electroconductive line 650*m* 0.08 mm for the electroconductive line 660*a*, and 0.4 mm for the electroconductive line 660*b*. The width of the lead wires extending from these lead wires and branding to the electrodes 642, 652, 662 along the widthwise direction of the substrate was 0.4 mm in width. The resistivity p of the feeder is 0.00002 Ω·mm, and the height t of the feeder is 10 μm. Further, the path length of the electroconductive line 660*a* connecting the electrical contact 661*a* and the electrode 662*a* is 67.7 mm. Further, the path length of the electroconductive line 660*b* connecting the electrical contact 661*b* and the electrode 662*b* is 327.7 mm. When resistance values of the respective sections for the feeders are derived, the following result is obtained. That is, R is 120Ω, r1 is 0.036Ω, r2 to r7 are 0.041Ω, r8 is 1.518Ω, r9 is 0.064Ω, r10 to r12 are 0.043Ω, and r13 is 1.634Ω. A result of the electric power supply of 100 V to the heater 600 including the feeders having the above-described constitutions so that the heat generating region is the heat generation width B is shown in Table 3. Table 3 shows the resistance, the current and the electric power consumption of each of the lead wires for the feeders.

TABLE 3

| Resistance (Ω) | | Current (A) | | Power (W) |
|---|---|---|---|---|
| r1 | 0.036 | i1 | 9.77 | 3.45 |
| r2 | 0.041 | i2 | 8.96 | 3.30 |
| r3 | 0.041 | i3 | 7.32 | 2.20 |
| r4 | 0.041 | i4 | 5.68 | 1.33 |
| r5 | 0.041 | i5 | 4.05 | 0.67 |
| r6 | 0.041 | i6 | 2.42 | 0.24 |
| r7 | 0.041 | i7 | 0.80 | 0.03 |
| r8 | 1.518 | i8 | 1.63 | 4.0 |
| r9 | 0.064 | i9 | 6.54 | 2.7 |
| r10 | 0.043 | i10 | 4.90 | 1.0 |
| r11 | 0.043 | i11 | 3.26 | 0.5 |
| r12 | 0.043 | i12 | 1.63 | 0.1 |
| r13 | 1.634 | i13 | 1.62 | 4.3 |

Accordingly, in this embodiment, the width of the electroconductive line 660*a* shorter in path length than the electroconductive line 660*b* is made thinner than the electroconductive line 660*b*. Specifically, the width, with respect to the widthwise direction of the substrate, of the lead wire for the electroconductive line 660*a* extending along the longitudinal direction of the substrate (i.e., the length with respect to the widthwise direction of the substrate) is made uniformly thin (narrow) compared with the width of the lead wire for the electroconductive line 660*b* extending along the longitudinal direction of the substrate (i.e., the length with respect to the widthwise direction of the substrate). That is, the width of the lead wire for the electroconductive line 660*a* extending along the longitudinal direction of the substrate is less than 0.4 mm.

By such a constitution, in this embodiment, a space in which the feeders are arranged in parallel in the widthwise direction of the substrate 610 can be saved. For that reason, enlargement in size of the substrate 610 in the widthwise direction can be suppressed.

Further, in this embodiment, each of the line widths is adjusted so that the respective resistances of the electroconductive lines 650, 660*a*, 660*b* are equal to each other. In this embodiment, by such a constitution, the values of the electric power consumed by the respective electroconductive lines are made close to each other, so that the values of the electric power supplied to the respective heat generating elements can be made close to each other.

In order to verify an effect of this embodiment, a comparison with Comparison Examples is made.

Figure 15:
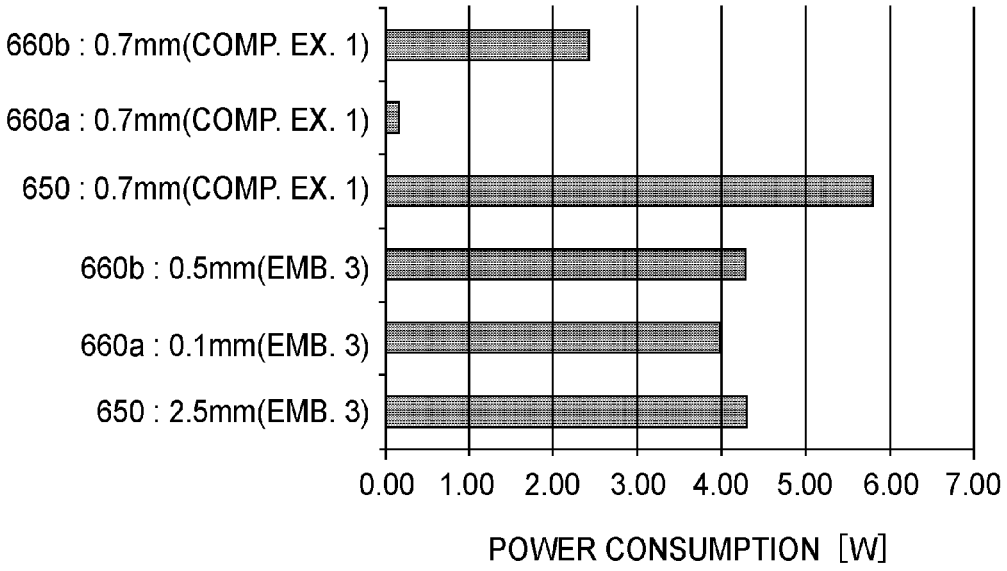
FIG. 15 illustrates an effect of Embodiment 3.

As shown in FIG. 15, the values of the electric power consumed by the electroconductive lines 650, 660*a*, 660*b* are 4.31 W, 4.01 W and 4.29 W, respectively, which are close to each other. On the other hand, in Comparison Example 1, the values of the electric power consumed by the electroconductive lines 650, 660*a*, 660*b* are 5.8 W, 0.17 W and 2.42 W, respectively, so that the values of the electric power consumed by the respective opposite electroconductive lines are different from each other. Further, as shown in FIG. 16, in this embodiment, compared with Comparison Example 1, it is understood that a variation in temperature distribution (a difference between a maximum and a minimum) is small.

As described above, in this embodiment, in the heater 600, the width of the lead wire having the resistance r1 is made thicker than the widths of the lead wire having the resistance r8, the lead wire having the resistance r9 and the lead wire having the resistance r13. For that reason, it is possible to suppress the electric power consumption (heat generation) at the lead wire having the resistance r1. That is, in this embodiment, by preferentially lowering the resistance of the lead wire through which a large current flows, the electric power consumption at the feeders can be reduced.

The lead wire having the resistance r1 is positioned in the region, of the heater 600, where the sheet P does not pass. For that reason, the heat generated at the lead wire having the resistance r1 is liable to become heat unnecessary for the fixing process. That is, by suppressing the heat generation of the lead wire having the resistance r1, it is possible to reduce a degree of the heat generation unnecessary for the fixing process of the heater 600. Therefore, according to this embodiment, the heat generation required for the fixing process can be made with high electric power efficiency.

Further, in this embodiment, the width of the electroconductive lines 650, 660 is made thinner than the width of the electroconductive line 640. For that reason, the electroconductive lines 650, 660 can be disposed in a narrow space of the substrate 610 with respect to the widthwise direction. Further, in this embodiment, the width of the electroconductive line 660 is made thinner than the width of the electroconductive line 650. For that reason, the electroconductive line 660 can be disposed in a narrow space of the substrate 610 with respect to the widthwise direction. Thus, it is possible to suppress upsizing of the substrate 610 with respect to the widthwise direction. That is, according to this embodiment, by thinning the width of the lead wire through which a small current flows, it is possible to suppress the upsizing of the substrate 610 with respect to the widthwise direction. Further, an increase in cost of the heater 600 can be suppressed.

Further, in this embodiment, the width of the electroconductive line 660*a* is made thinner than the width of the electroconductive line 660*b*. For that reason, the values of the electric power consumption by the electroconductive lines 650, 660*a*, 660*b* can be adjusted to substantially close values. Accordingly, according to this embodiment, it is possible to suppress generation of the temperature non-uniformity of the heat generating elements with respect to the longitudinal direction of the heat generating elements.

Other Embodiments

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples which are based on the sheets P are fed with the center thereof aligned with the center of the fixing device 40, but the sheets P may also be supplied on another sheet feeding basis of the fixing device 40. For that reason, e.g., in the case where the sheet feeding basis is an end(-line) feeding basis, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions, but expands at one of the opposite end portions.

The number of patterns of the heat generating region of the heater 600 is not limited to two. For example, three or more patterns may be provided.

The forming method of the heat generating element 620 is not limited to those disclosed in Embodiment 1. In Embodiment 1, the electrode 642 and in the electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The number of the electrical contacts limited to three or four. For example, five or more electrical contacts may also be provided depending on the number of heat generating patterns required for the fixing device.

Further, in the fixing device 40 in Embodiment 1, by the constitution in which all of the electrical contacts are disposed in one longitudinal end portion side of the substrate 610, the electric power is supplied from one end portion side to the heater 600, but the present invention is not limited to such a constitution. For example, a fixing device 40 having a constitution in which electrical contacts are disposed in a region extended from the other end of the substrate 610 and then the electric power is supplied to the heater 600 from both of the end portions may also be used.

The arrangement constitution of the switches connecting the heater 600 with the power source 110 is not limited to that in Embodiment 1. For example, a switch constitution as in a conventional example shown in each of (a) and (b) of FIG. 12. That is, a polar (electric potential) relationship between the electrical contacts and power source contacts may be fixed or not fixed.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiments 1-4 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example, which are prepared by adding necessary device, equipment and casing structure.

The image heating apparatus is not limited to the apparatus for fixing a toner image on a sheet P. It may be a device for fixing a semi-fixed toner image into a completely fixed image, or a device for heating an already fixed image. Therefore, the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-150778 filed on Jul. 24, 2014, which is hereby incorporated by reference herein in its entirety.

What is claimed is:

1. A heater connectable to an electric power supply portion having a first terminal and a second terminal said heater comprising:

an elongate substrate;

a first electrical contact provided on said substrate and electrically connectable with the first terminal;

a plurality of second electrical contacts provided on said substrate and electrically connectable with the second terminal;

a plurality of electrodes including a plurality of first electrodes electrically connected with said first electrical contact and a plurality of second electrodes electrically connected with one of said second electrical contacts, said first electrodes and said second electrodes being arranged alternately with predetermined gaps in a longitudinal direction of said substrate;

a plurality of heat generating portions provided between adjacent ones of said electrodes so as to electrically connect between adjacent electrodes, said heat generating portions being capable of generating heat by electric power supply between adjacent electrodes;

a first electroconductive line extending in a longitudinal direction and electrically connected to said first electrical contact and said first electrodes; and a second electroconductive line extending in the longitudinal direction and electrically connected to one of said second electrical contacts and one said second electrodes, wherein a cross-sectional area of said first electroconductive line is larger than a cross-sectional area of said second electroconductive line.

2. A heater according to claim 1, wherein a line width of said first electroconductive line is wider than a line width of said second electroconductive line.

3. A heater according to claim 2, wherein said first electroconductive line and said second electroconductive line are made of the same material.

4. A heater according to claim 1, further comprising a third electroconductive line extending in the longitudinal direction of said substrate and electrically connected to another of said second electrical contacts and another of said second electrodes.

5. A heater according to claim 4, wherein a cross-sectional area of said first electroconductive line is larger than a cross-sectional area of said third electroconductive line.

6. A heater according to claim 5, wherein a line width of said first electroconductive line is wider than a line width of said third electroconductive line.

7. A heater according to claim 1, wherein said first electrical contact and said second electrical contacts are all disposed in one end portion side of said substrate with respect to the longitudinal direction.

8. An image heating apparatus comprising:

(i) an electric energy supplying portion provided with a first terminal and a second terminal;

(ii) a rotatable member configured to heat an image on a sheet; and (iii) a heater configured to heat said rotatable member, said heater including:

(iii-i) an elongate substrate;

(iii-ii) a first electrical contact provided on said substrate and electrically connectable with the first terminal;

(iii-iiii) a plurality of second electrical contacts provided on said substrate and electrically connectable with the second terminal;

(iii-iv) a plurality of electrodes including a plurality of first electrodes electrically connected with said first electrical contact and a plurality of second electrodes electrically connected with either one of said second electrical contacts, said first electrodes, and said second electrodes being arranged alternately with predetermined gaps in a longitudinal direction of said substrate;

(iii-v) a plurality of heat generating portions provided between adjacent ones of said electrodes so as to electrically connect between adjacent electrodes, said heat generating portions being capable of generating heat by electric power supply between adjacent electrodes;

(iii-vi) a first electroconductive line extending in a longitudinal direction and electrically connected to said first electrical contact and said first electrodes; and (iii-vii) a second electroconductive line extending in a longitudinal direction and electrically connected to one of said second electrical contacts and one of said first electrodes, wherein a cross-sectional area of said first electroconductive line is larger than a cross-sectional area of said second electroconductive line.

9. An image heating apparatus according to claim 8, wherein a line width of said first electroconductive line is wider than a line width of said second electroconductive line.

10. An image heating apparatus according to claim 9, wherein said first electroconductive line and said second electroconductive line are made of the same material.

11. An image heating apparatus according to claim 8, further comprising a third electroconductive line extending in the longitudinal direction of said substrate and electrically connected to another of said first second electrical contacts and another of said second electrodes.

12. An image heating apparatus according to claim 11, wherein a cross-sectional area of said first electroconductive line is larger than a cross-sectional area of said second electroconductive line.

13. An image heating apparatus according to claim 12, wherein a line width of said first electroconductive line is wider than a line width of said third electroconductive line.

14. An image heating apparatus according to claim 8, wherein said first electrical contact and said second electrical contacts are all disposed in one end portion side of said substrate with respect to the longitudinal direction.

* * * * *